US010890302B2

(12) United States Patent
Boulanger et al.

(10) Patent No.: US 10,890,302 B2
(45) Date of Patent: Jan. 12, 2021

(54) LIGHTING ARRANGEMENT WITH BATTERY BACKUP

(71) Applicant: CP IP Holdings Limited, Hong Kong (CN)

(72) Inventors: Dave Boulanger, Hong Kong (CN); Maciej Nowakowski, West Vancouver (CA)

( * ) Notice: Subject to any disclaimer, the term of this patent is extended or adjusted under 35 U.S.C. 154(b) by 0 days.

(21) Appl. No.: 15/931,656

(22) Filed: May 14, 2020

(65) Prior Publication Data

US 2020/0340635 A1 Oct. 29, 2020

Related U.S. Application Data

(63) Continuation-in-part of application No. 16/205,290, filed on Nov. 30, 2018, now Pat. No. 10,663,130, which is a continuation-in-part of application No. 16/032,321, filed on Jul. 11, 2018, now Pat. No. 10,174,887, which is a continuation-in-part of application No. 15/248,665, filed on Aug. 26, 2016, now Pat. No. 10,039,161.

(60) Provisional application No. 62/931,446, filed on Nov. 6, 2019, provisional application No. 62/889,482, filed on Aug. 20, 2019, provisional application No. 62/210,464, filed on Aug. 27, 2015.

(51) Int. Cl.

| | |
|---|---|
| ***F21V 17/16*** | (2006.01) |
| ***F21S 9/02*** | (2006.01) |
| ***H05B 45/37*** | (2020.01) |
| *F21V 23/06* | (2006.01) |
| *F21Y 115/10* | (2016.01) |

(52) U.S. Cl.

CPC ..... *F21S 9/022* (2013.01); *H05B 45/37* (2020.01); *F21V 17/164* (2013.01); *F21V 23/06* (2013.01); *F21Y 2115/10* (2016.08)

(58) Field of Classification Search

None

See application file for complete search history.

(56) References Cited

U.S. PATENT DOCUMENTS 6,158,882 A * 12/2000 Bischoff, Jr. ..... F21V 23/005 362/249.02

2017/0307155 A1* 10/2017 Brandes ..... F21V 23/023

* cited by examiner

*Primary Examiner* — Vip Patel

(74) *Attorney, Agent, or Firm* — Black, McCuskey, Souers & Arbaugh LPA

(57) ABSTRACT

A lighting arrangement can include a luminaire, a driver circuitry assembly, and a battery backup portion. The luminaire can have light emitting diodes in an array string positioned in a first housing and a first wiring extending from the array string to a first plug connector. The driver circuitry assembly can drive the plurality of light emitting diodes and include circuitry with a rectifier and an IC chip positioned in a second housing and a second wiring extending from the circuitry to a second plug connector engageable with the first plug connector. The battery backup portion can be selectively positionable between the driver circuitry assembly and the external AC grid and have one or more batteries and a converter portion with a DC-AC inverter positioned in a third housing. The third housing and the second housing are interconnectable.

6 Claims, 23 Drawing Sheets

LIGHTING ARRANGEMENT WITH BATTERY BACKUP

CROSS-REFERENCE TO RELATED APPLICATIONS

This application is a continuation-in-part of pending U.S. patent application Ser. No. 16/205,290 (hereafter the '290 application), for a LIGHTING ARRANGEMENT WITH BATTERY BACKUP, filed on 30 Nov. 2018. The '290 application was a continuation-in-part of U.S. patent application Ser. No. 16/032,321 (hereafter the '321 application), for a LIGHTING ARRANGEMENT WITH BATTERY BACKUP, filed on 11 Jul. 2018 and now U.S. Pat. No. 10,174,887, issued 8 Jan. 2019. The '321 application was a continuation-in-part of U.S. patent application Ser. No. 15/248,665 (hereafter the '665 application) for a LIGHTING ARRANGEMENT WITH BATTERY BACKUP, filed on 8 Aug. 2016, now U.S. Pat. No. 10,039,161 issued 31 Jul. 2018. The '665 application claimed priority to U.S. Prov. Pat. App. Ser. No. 62/210,464, filed 27 Aug. 2015. This application also claims priority to U.S. Prov. Pat. App. Ser. No. 62/889,482, filed 20 Aug. 2019 and also U.S. Prov. Pat. App. Ser. No. 62/931,446, filed 6 Nov. 2019. All of the applications identified above are hereby incorporated by reference in their entireties. The present application claims priority to all of the applications identified above.

BACKGROUND

1. Field

The present disclosure relates to lighting devices or fixtures operable to emit light.

2. Description of Related Prior Art

U.S. Pub. No. 2012/0187852 discloses an ELEVATOR EMERGENCY LED LIGHTING POWER SUPPLY ASSEMBLY. The elevator emergency LED lighting power supply assembly including an inverter that receives DC power from a battery and outputs backup power to LED lamps of an elevator lighting system. An LED driver is connected to the inverter, is connectable to an LED lamp of the elevator lighting system, receives AC power from the inverter, and outputs DC power sufficient to power an LED lamp. A relay is connected between the inverter and the LED driver, is connectable to a primary elevator electrical power supply, and allows AC power to flow from a primary elevator electrical power supply to elevator lighting system LEDs through the LED driver as long as AC power is available from a primary elevator electrical power supply. Upon loss of power from the primary elevator power supply the relay switches contacts and provides to the LED driver AC power received from the inverter.

U.S. Pub. No. 2016/0230973 discloses an LED LUMINAIRE WITH INTEGRATED BATTERY BACKUP. The LED luminaire with an integrated battery backup is divided into a hidden infrastructure portion and a decorative body portion. The luminaire body has a main lighting deck with at least one LED mounted thereon and a decorative skirt extending from the main lighting deck. A diffuser panel is received over the main lighting deck. The hidden infrastructure portion includes a light fixture housing configured and arranged to be mounted within a building infrastructure, an emergency battery backup assembly received within the light fixture housing wall, and a housing fixture bracket secured within the light fixture housing to support the emergency backup assembly in the upper portion of the light fixture housing.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A lighting arrangement can include a luminaire, a driver circuitry assembly, and a battery backup portion. The luminaire can have a plurality of light emitting diodes in an array string. The luminaire can also have a first wiring extending from the array string and terminating in a first electrical plug connector. The luminaire can also have a first housing, wherein the plurality of light emitting diodes in the array string is positioned in the first housing and the first electrical plug connector is positioned outside of the first housing. The driver circuitry assembly can drive the plurality of light emitting diodes and include circuitry with a rectifier and an IC chip configured to drive the plurality of light emitting diodes with the rectified voltage provided by the rectifier. The driver circuitry assembly can also have a second wiring extending from the circuitry and terminating in a second electrical plug connector. The first electrical plug connector and the second electrical plug connector can be selectively engageable with one another. The driver circuitry assembly can also have a third wiring configured to connect with the external AC grid. The driver circuitry assembly can also have a second housing wherein the rectifier and the IC chip are positioned in the second housing and the second electrical plug connector is positioned outside of the second housing. The battery backup portion can be selectively positionable between the driver circuitry assembly and the external AC grid and have one or more batteries and a converter portion with a DC-AC inverter. The converter portion can be configured to receive power from the one or more batteries or the external AC grid. The converter portion can include a microcontroller unit, the microcontroller unit can be configured to route AC power to the rectifier of the driver circuitry assembly from either the external AC grid or from the one or more batteries when the driver circuitry assembly and the battery backup portion are engaged with one another. The battery backup portion can also include a fourth wiring selectively engageable with the third wiring of the driver circuitry assembly. The battery backup portion can also include a fifth wiring selectively engageable with the external AC grid. The battery backup portion can also have a third housing containing the one or more batteries and the converter portion. The fourth wiring and the fifth wiring can extend out of the third housing. The third housing and the second housing are selectively interconnectable with one another.

BRIEF DESCRIPTION OF THE DRAWINGS

The detailed description set forth below references the following drawings.

DETAILED DESCRIPTION

Figure 1:
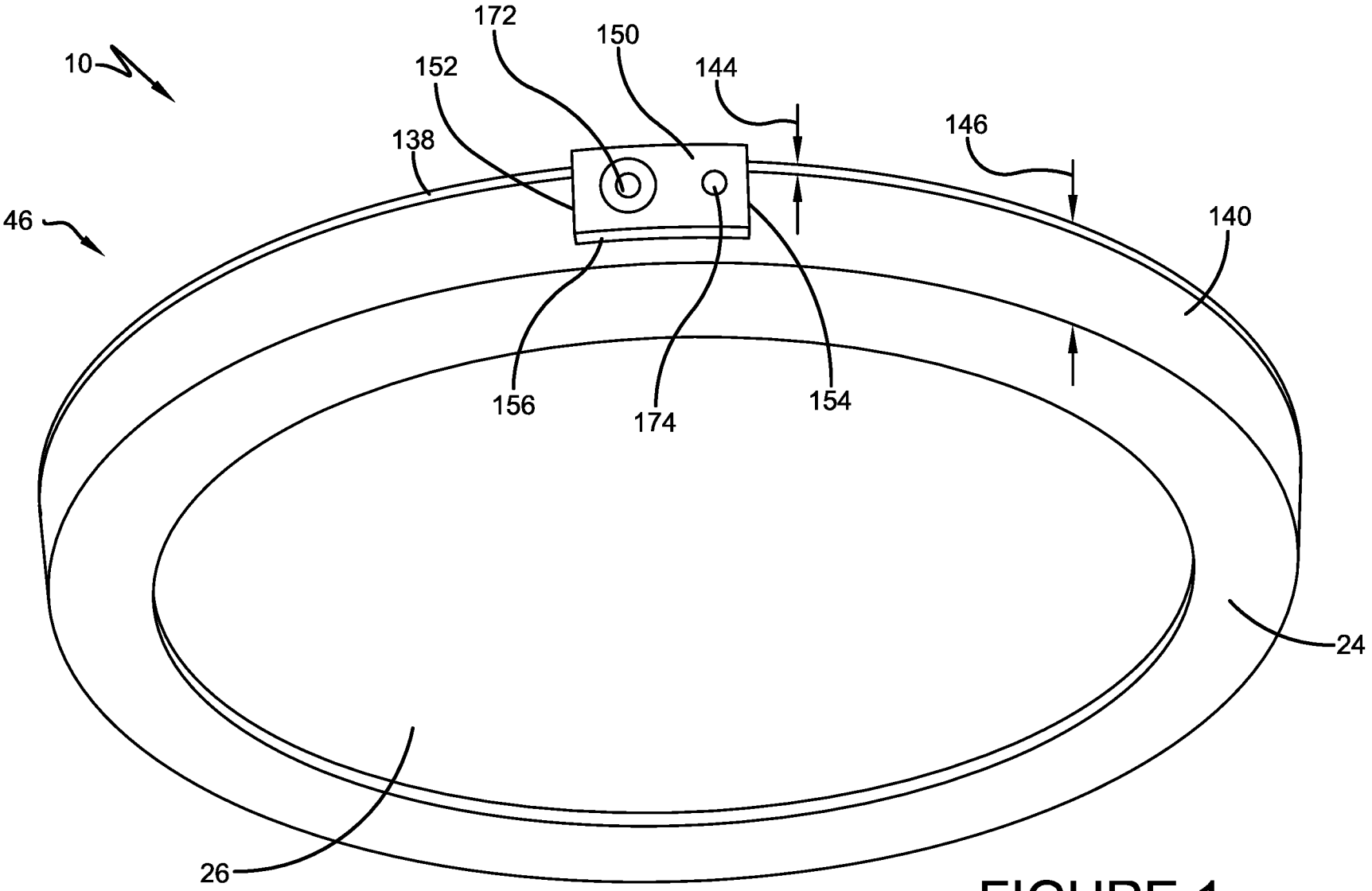
FIG. 1 is a perspective view of a lighting arrangement, mounted in a ceiling, according to an exemplary embodiment of the present disclosure.
Figure 2:
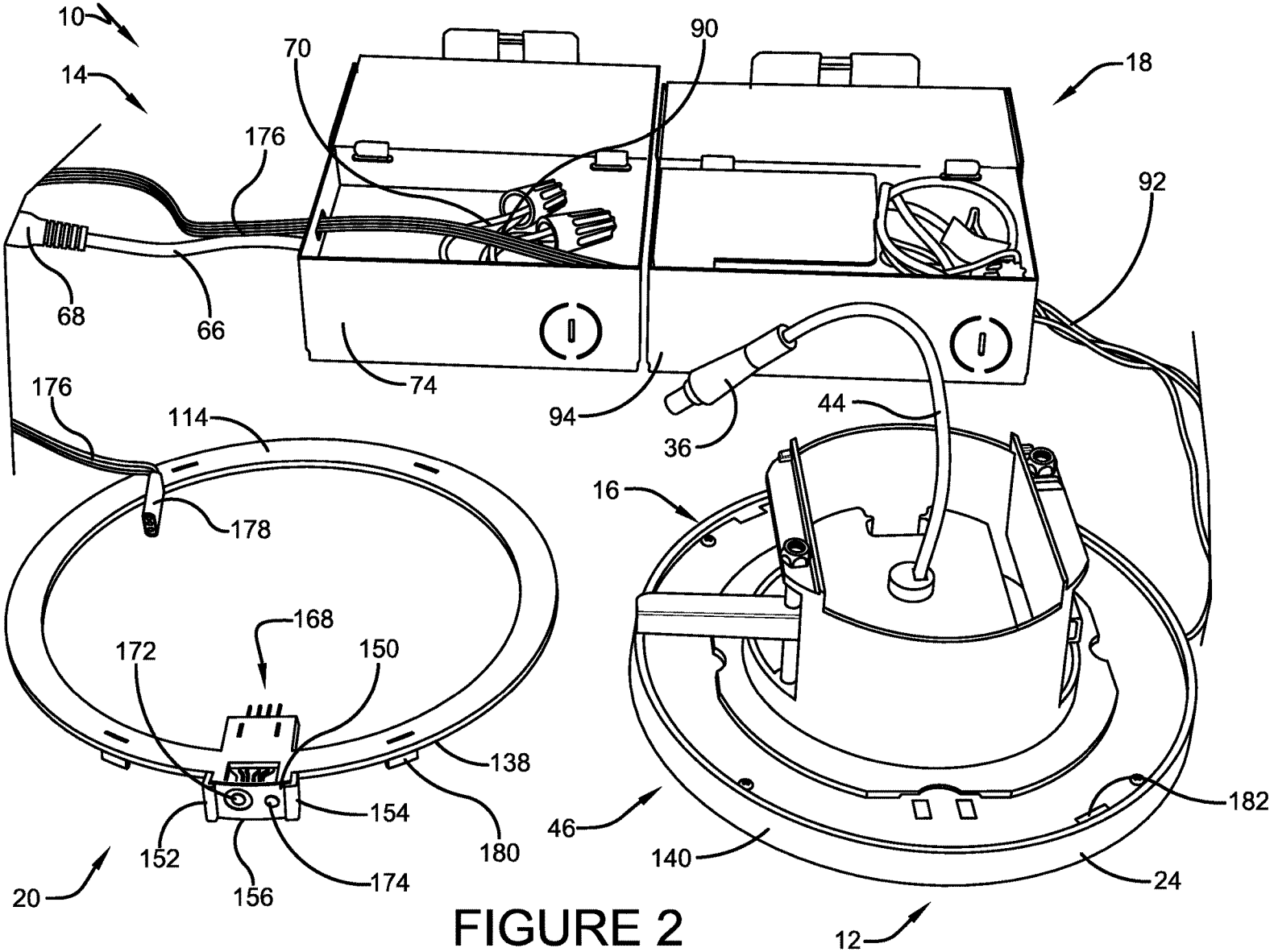
FIG. 2 is a perspective view of the components of the lighting arrangement shown in FIG. 1 wherein the components are partially disassembled.
Figure 3:
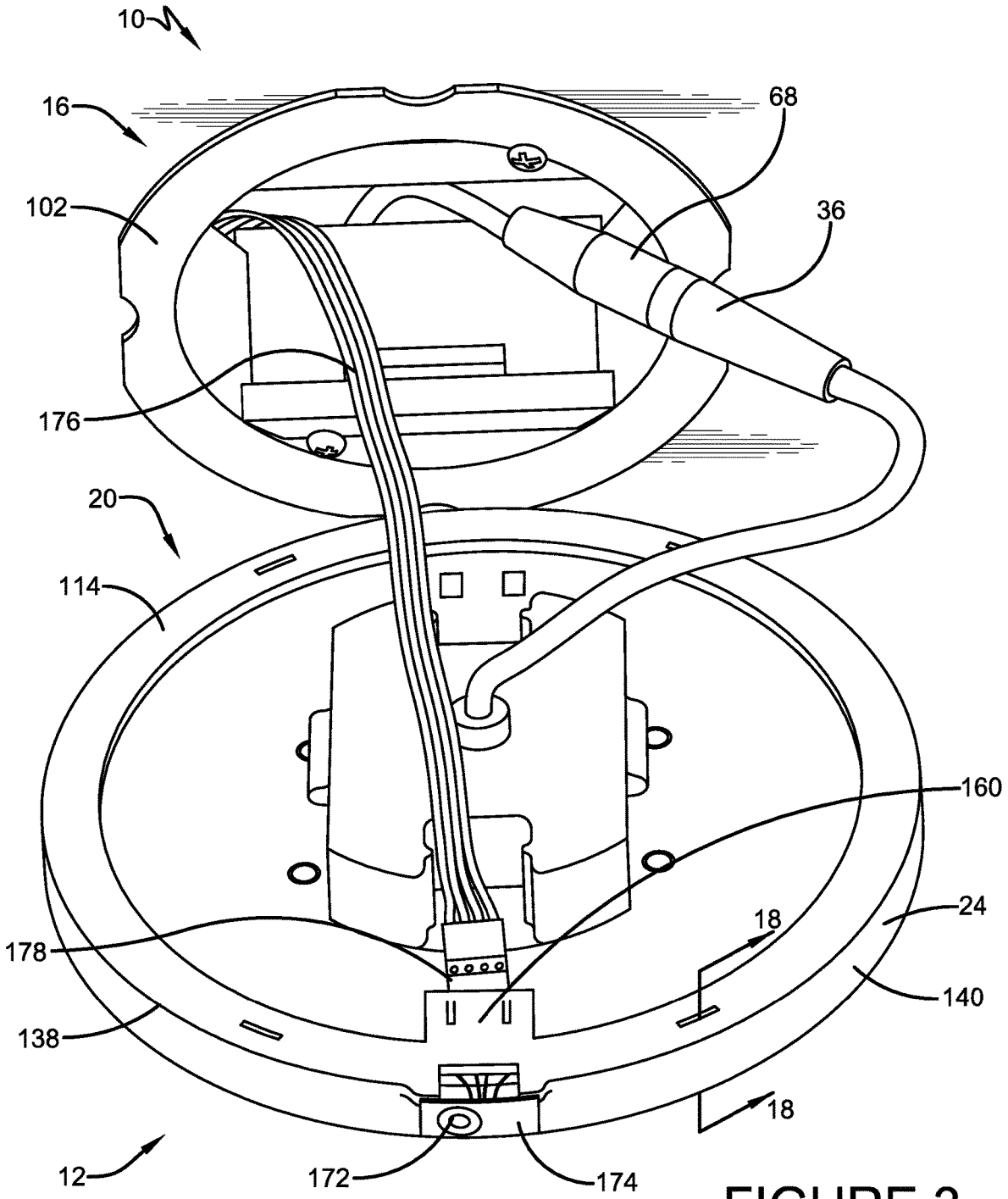
FIG. 3 is a perspective view of the lighting arrangement shown in FIG. 1 wherein a luminaire of the lighting arrangement is disassembled from a mounting bracket of the lighting arrangement.

An exemplary lighting arrangement 10 is shown mounted in a ceiling in FIG. 1. As shown in FIG. 2, the exemplary lighting arrangement 10 includes a luminaire 12, a driver circuitry assembly 14, a mounting bracket 16, a battery backup portion 18, and a trim ring assembly 20. As indicated by FIG. 3, the exemplary driver circuitry assembly 14 and the exemplary battery backup portion 18 can be positioned about the ceiling, the exemplary mounting bracket 16 can be mounted in an aperture formed in the ceiling, the exemplary trim ring assembly 20 can be mounted on the exemplary luminaire 12, and the exemplary luminaire 12 can be selectively engaged with the exemplary mounting bracket 16.

Figure 4:
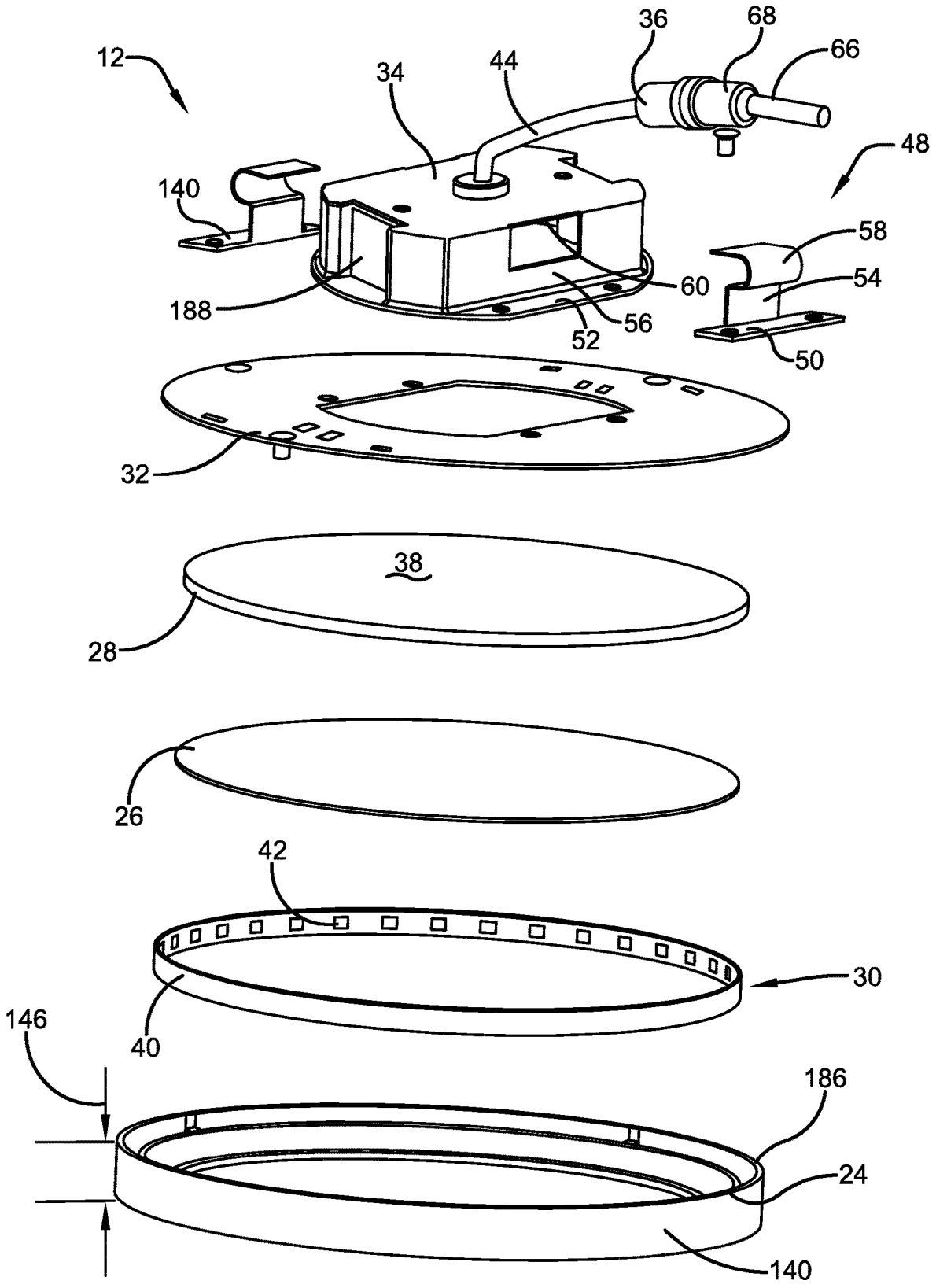
FIG. 4 is an exploded view of the luminaire of the lighting arrangement shown in FIG. 1.

Referring now to FIG. 4, the exemplary luminaire 12 includes a frame 24, a diffusor 26, a light guide 28, a light engine 30, a back cover 32, an alignment cap 34, and first electrical plug connector 36. The frame 24 can take any desired shape, including square, circular, oval, rectangular, or any other shape. The diffusor 26, the light guide 28, and the light engine 30 can be positioned in the frame 24. The exemplary frame 24 and back cover 32 cooperate to define a first housing 46. The diffusor 26, the light guide 28, and the light engine 30 can be enclosed in a cavity defined by the housing 46, which is formed by the frame 24 and the back cover 32. The light guide 28 can include a backing paper on an upper surface 38. The light engine 30 can surround the light guide 28. The light engine 30 can include a printed circuited board (PCB) 40 and a plurality of light emitting diodes (LEDs) 42. The LEDs 42 can be arranged in one or more array strings, such as referenced in FIG. 5. The exemplary luminaire 12 also includes first wiring 44 extending from the PCB 40 to the first electrical plug connector 36. The first electrical plug connector 36 is positioned outside of the first housing 46.

The luminaire 12 can also include a pair of lateral springs 48, 148. The exemplary lateral springs 48, 148 are identically-shaped. The exemplary spring 48 includes a first flat portion 50 mountable inside of the alignment cap 34, against a lower flange 52 of the alignment cap 34. The first flat portion 50 and the lower flange 52 can be interconnected with one or more fasteners, such as screws. The exemplary spring 48 also includes a planar vertical portion 54 that follows a wall 56 of the alignment cap 34. The exemplary spring 48 also includes a bowed portion 58 extending from the vertical portion 54 radially outward from a center axis of the luminaire 12. The bowed portion 58 extends outside of the alignment cap 34 through an aperture 60 in the alignment cap 34.

Figure 5:
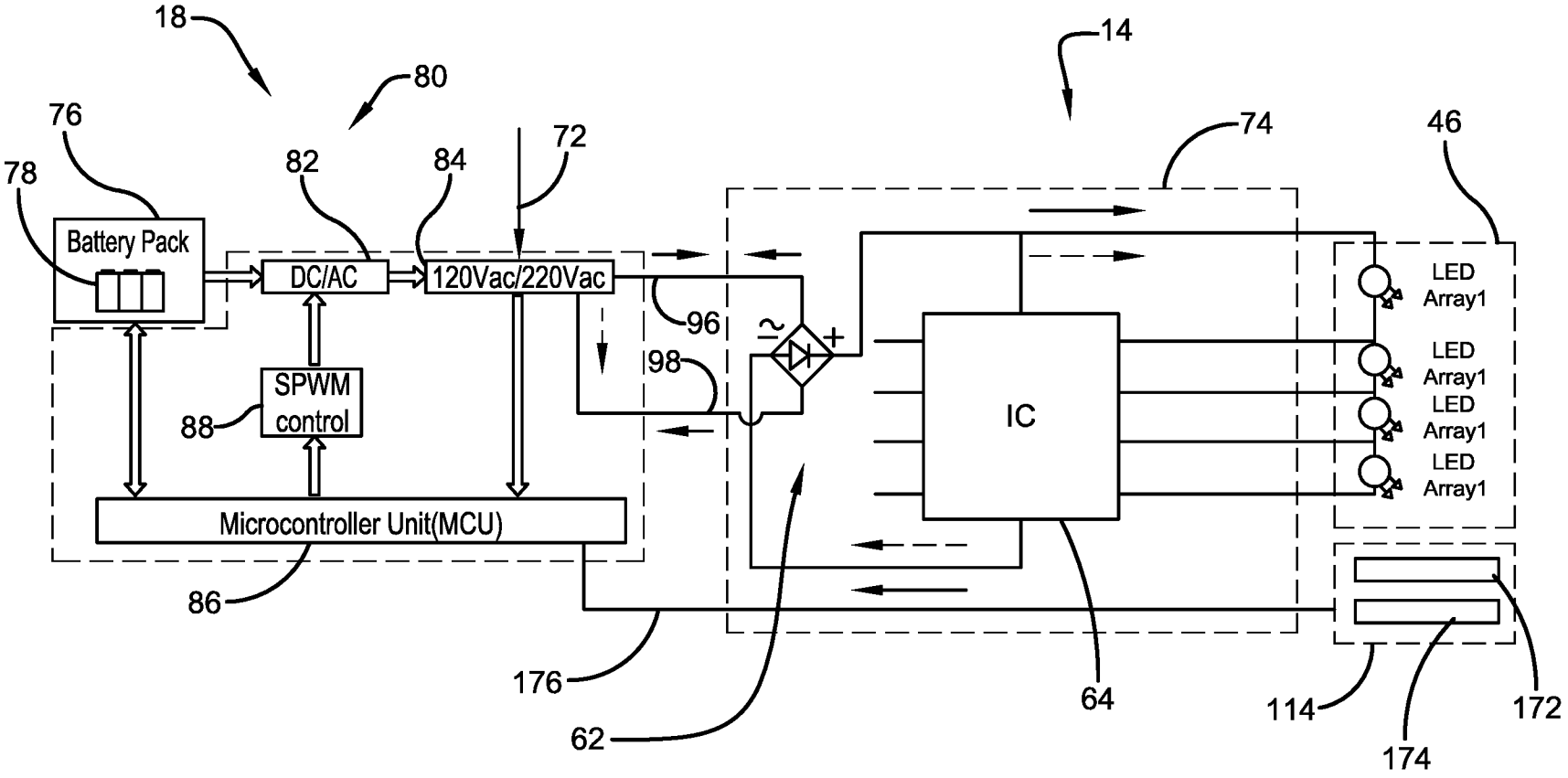
FIG. 5 is a circuit schematic of the lighting arrangement shown in FIG. 1.
Figure 6:
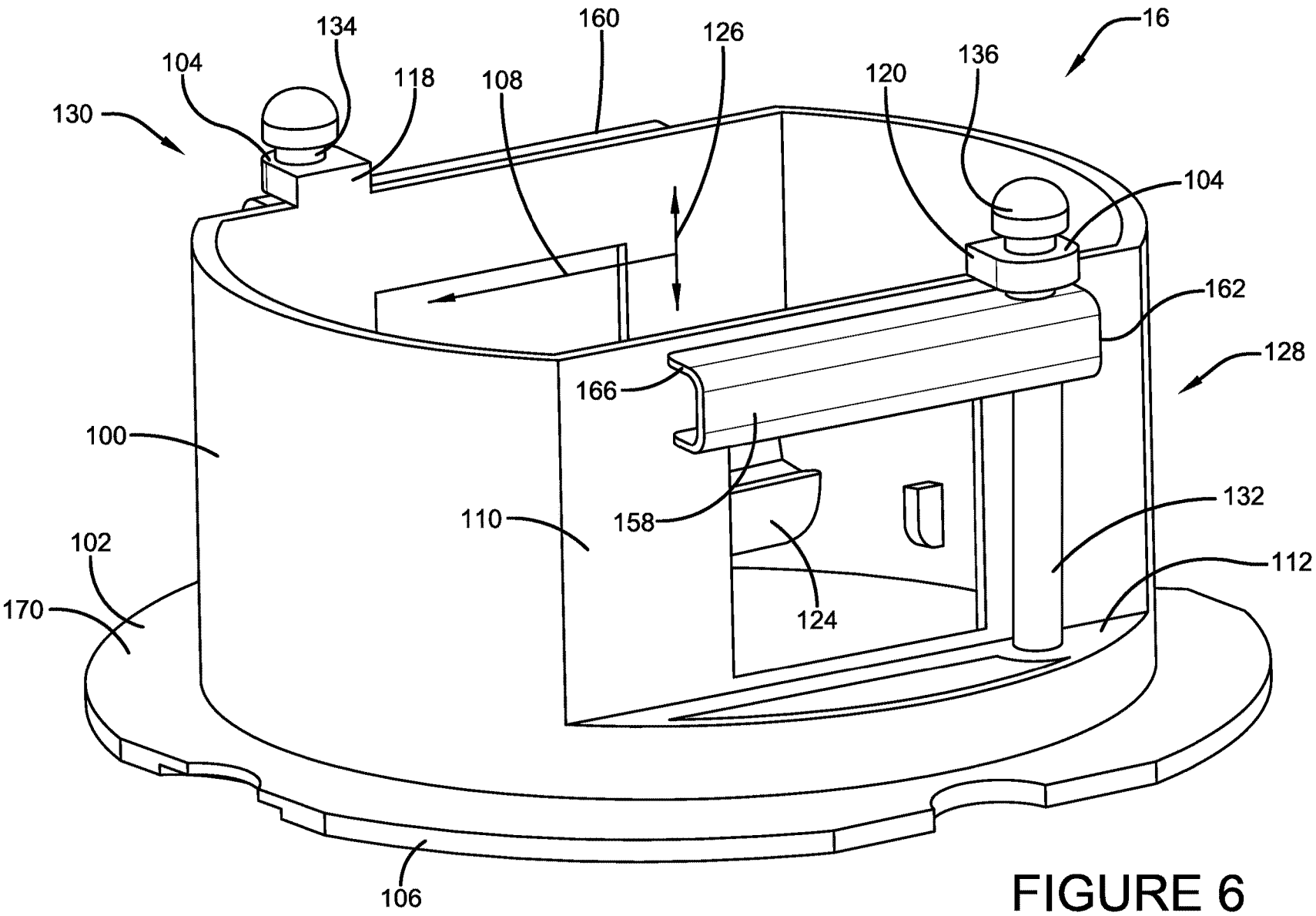
FIG. 6 is a first perspective view, generally from the side and above, of the mounting bracket with locking arms in a retracted position.
Figure 7:
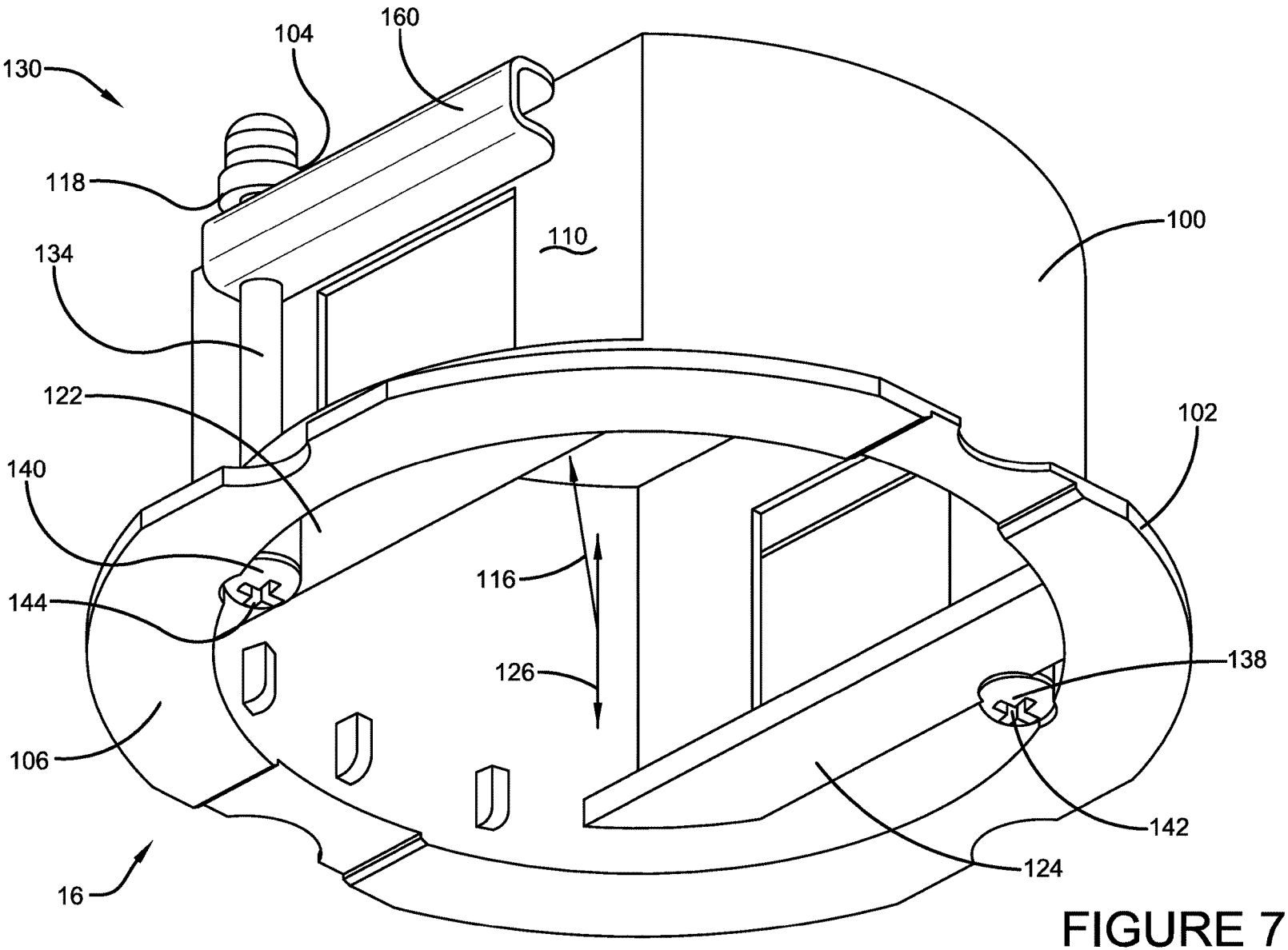
FIG. 7 is a second perspective view, generally from the side and below, of the bracket with locking arms in a retracted position shown in FIG. 6.

FIG. 5 is a circuit schematic according to an exemplary embodiment of the present disclosure. The driver circuitry assembly 14 is configured to drive the plurality of light emitting diodes 42 and includes circuitry with a rectifier 62 and an IC chip 64 configured to drive the plurality of light emitting diodes 42 with the rectified voltage provided by the rectifier 62. Referring now to FIG. 2, the exemplary driver circuitry assembly 14 also has second wiring 66 extending from the circuitry and terminating in a second electrical plug connector 68. The first electrical plug connector 36 and the second electrical plug connector 68 are selectively engageable with one another. The driver circuitry assembly 14 also has third wiring 70 configured to connect with the external AC grid, which is referenced at 72 in FIG. 5. It is noted that the wiring 70 is shown spliced to wiring from the battery backup portion 18 in FIG. 2, but the wiring 70 can be connected to the external AC grid 72. The exemplary driver circuitry assembly 14 also has a second housing 74. The rectifier 62 and the IC chip 64 are positioned in the second housing 74 and the second electrical plug connector 68 is positioned outside of the second housing 74. The third wiring 70 can also extend out of the second housing 74 or in operation be positioned within the housing 74.

The battery backup portion 18 is selectively positionable between the driver circuitry assembly 14 and the external AC grid 72. Referring again to FIG. 5, the exemplary battery backup portion 18 includes a battery portion 76 having one or more batteries 78 and a converter portion 80 with a DC-AC inverter/converter 82. The converter portion 80 can be operably disposed between the battery portion 76 and the luminaire 12. The converter portion 80 can be configured to receive power from the one or more batteries 78 or the external AC grid 72. The converter portion 80 can itself be powered by the battery portion 76. The DC-AC inverter/converter 82 can be a functional group that includes a plurality of components such as a transistor, diode, capacitor, and transformer. The DC-AC inverter/converter 82 can convert relatively low DC voltage from the battery portion 76 into AC voltage. The box 84 simply refers to the output of the converter portion 80.

The exemplary converter portion 80 also includes a microcontroller unit 86. The microcontroller unit 86 is configured to route AC power to the rectifier 62 of the driver circuitry assembly 14 from either the external AC grid 72 or from the one or more batteries 78 when the driver circuitry assembly 14 and the battery backup portion 18 are engaged with one another. The microcontroller unit 86 can include voltage dividers, amplifiers, RAM, a timer, A/D, PWM, and other integrated functions. In one or more embodiments of the present disclosure, the microcontroller unit 86 can include an enhanced 8051 series MCU, such as a SH79F081A provided by Sino Wealth, alongside voltage dividers and amplifiers that enable the high voltages and currents to be measured by the A/D.

The exemplary converter portion 80 also includes a sinusoidal pulse-width modulation (SPWM) module 88. The SPWM module 88 can be integral with the microcontroller unit 86. The SPWM module 88 can generate a sinusoidal modulated pulse in response to a control signal emitted by the microcontroller unit 86 to SPWM module 88. The pulse can be utilized to control the ON/OFF status of a transistor of the converter 82, such as a MOSFET. When the transistor is open, the exemplary converter portion 80 can be engaged to communicate AC power to the rectifier 54. The microcontroller unit 86 can be arranged to monitor the delivery of AC power to the luminaire 12 from the external AC grid 72. When the primary or main electrical power is off due to an emergency, or power outage, or some other condition, the microcontroller unit 86 can emit the pulse to engage the other portions of the exemplary converter portion 80 and supply power to the luminaire 12 from the battery portion 76.

Referring again to FIG. 2, the exemplary battery backup portion 18 also includes fourth wiring 90 selectively engageable with the third wiring 70 of the driver circuitry assembly 14. The exemplary battery backup portion 18 also includes fifth wiring 92 selectively engageable with the external AC grid 72.

The battery portion 76 can have any desired physical size. The battery portion 76 can be defined by a single battery or an array of batteries 78 connected in series or in parallel. By way of example and not limitation, the battery portion 76 can include one or more Samsung® Model ICR18650-26F batteries 78, each having a length of sixty-five millimeters and a diameter of eighteen and four-tenths millimeters. This yields a volume of seventeen-thousand two-hundred and eighty-four square millimeters. The battery portion 76 can be rated at 3.8 volts, 2600 mAh and have a capacity is 9.88 Wh after being charged. In one embodiment of the present disclosure, three batteries 78 can be connected in series having a volume of fifty-one-thousand eight-hundred and fifty-one square millimeters.

The exemplary battery portion 76 and exemplary converter portion 80 can define an emergency back-up to the luminaire 12. The battery portion 76 and exemplary converter portion 80 can be formed as an integral exemplary battery backup portion 18 that can be attached to a junction box delivering electrical power to the luminaire 12. The exemplary lighting arrangement 10 further includes a third housing 94 containing the exemplary battery backup portion 18. The fourth wiring 90 and the fifth wiring 92 can extend out of the third housing 94. The exemplary third housing 94 and the exemplary second housing 74 are selectively interconnectable with one another. Thus, a user may operate the luminaire 12 without the battery backup portion 18 if desired.

In one or more exemplary embodiments, the battery portion 76 can provide thirty watt-hours of power. When supporting a twenty-watt luminaire 12 (or fixture), the battery portion 76 can thus provide power for one and a half hours. The power can be provided almost instantaneously; when power is lost from the standard or regular or non-emergency source, the microcontroller unit 86 can engage the inverter 82 to supply 120V, AC power to the luminaire 12.

The output signal of the exemplary converter portion 80 is directed through the bridge rectifier 54. The signal can then be received by the IC chip 56. The luminaire 12 can control individual LEDs of an LED array string based on the input voltage. The quantity of LEDs can be variable. Unlike a traditional arrangement, the luminaire 12 can be configured to drive the IC chip 56 directly in relatively high voltage rectified AC mode and not to transform relatively high voltage rectified AC to low voltage DC. IC chip 56 is configured to provide device appropriate current flow into the LED array strings. Many different step-IC chips 56 can be utilized in various embodiments of the present disclosure, depending on different functions that may be desired, such as dimming or particular color dimming for differently colored LEDs. One example of a step-IC that can be utilized in one or more embodiments of the present disclosure for the IC chip 56 is a MAP9001 supplied by MagnaChip Semiconductor. The MAP9001 has the ability to accept voltages between 90V and 270V rectified voltage.

AC can pass to the rectifier 54 from the box 84 along line 96. AC from the rectifier 54 can return to the box 84 along line 98 (neutral). The power flow is illustrated with solid and dashed arrows. Because the AC is rectified there are two half cycles. In the positive half cycle (solid arrows), the power flows from line 96, through the rectifier 54, and out of the terminal marked (+), around to the LED strings, through the chip 56, back through the rectifier 54, and then to neutral 98. During the negative half cycle (dashed arrows), the power flows from neutral 96, through the rectifier 54, out of the terminal marked (+), through the LED strings, through the IC chip 56, back through the rectifier 54, and then through the line 96. The arrangement described above results in the unexpected benefit of a smaller backup battery along with the number of light emitting diodes (LEDs) being variable based on the battery voltage.

FIGS. 6-11 disclose the mounting bracket 16 according to an embodiment of the present disclosure. The mounting bracket 16 is configured to be selectively mounted in an aperture of a wall, such as a vertical wall or a horizontal wall (a ceiling). The luminaire 12 is selectively engageable with the mounting bracket 16. The exemplary bracket 16 includes a circumferential wall 100 extending along and about a central longitudinal axis 126 and a circumferential flange 102 projecting radially from the wall 100, away from the axis 126. It is noted that the axis 126 can be collinear with the central axis of the luminaire 12. The exemplary circumferential wall 100 and the exemplary circumferential flange 102 are integrally formed with respect to one another. The exemplary bracket 16 extends between a topmost surface 104 and a bottommost surface 106. The exemplary circumferential flange 102 extends radially outward from the exemplary circumferential wall 100 at the exemplary bottommost surface 106.

The exemplary circumferential wall 100 extends to a maximum radius, referenced at 108. The exemplary circumferential wall 100 includes two notches that truncate the maximum radius 108. Each of the exemplary notches are similarly sized and shaped and include a vertical wall 110 and a horizontal wall 112. The exemplary circumferential flange 102 also extends to a maximum radius, referenced at 116. The exemplary circumferential flange 102 also includes various notches that truncate the maximum radius 116.

The exemplary bracket 16 also includes a pair of bosses 118, 120. The exemplary bosses 118, 120 define the top edge 104 and include unthreaded apertures. The exemplary bosses 118, 120, the exemplary circumferential wall 100, and the exemplary circumferential flange 102 are integrally formed with respect to one another.

The exemplary bracket 16 also includes a pair of shelves 122, 124. The exemplary shelves 122, 124 extend radially inward from a radially-inner surface of the exemplary circumferential wall 100. The exemplary shelves 122, 124 extend radially inward toward the axis 126 126 of the bracket 16. The exemplary shelves 122, 124 serve the engage the bowed portions of the lateral springs 48, 148. The luminaire 12 can be mounted to the bracket 16 through engagement between the shelves 122, 124 and springs 48, 148. The bowed portions are bent radially-inward, toward the axis 16, when the cap 34 of the luminaire 12 is inserted into the bracket 16. The bowed portions recover their shapes and rest on the shelves 122, 124 when insertion is complete. The exemplary shelves 122, 124, the exemplary circumferential wall 100, and the exemplary circumferential flange 102 are integrally formed with respect to one another.

The exemplary bracket 16 also includes a pair of worms 128, 130. Each exemplary worm 128, 130 includes a respective threaded shaft 132, 134. Each exemplary shaft 132, 134 extends from a first end mounted in an aperture of one of the bosses 118, 120. The exemplary shafts 132, 134 freely rotate in the apertures of the bosses 118, 120. Each exemplary worm 128, 130 includes a nut or cap, such as cap 136, to prevent the shafts 132, 134 from backing out of the apertures of the bosses 118, 120.

The exemplary bracket 16 also includes a pair of locking arms 158, 160. Each of the exemplary locking arms 158, 160 extend between a first end a second end, such as first end 162 and second end 166. Each of the exemplary locking arms 158, 160 includes a threaded aperture. The exemplary threaded shafts 132, 134 are received in the exemplary threaded apertures of the locking arms 158, 160. The respective, exemplary first ends of the exemplary locking arms 158, 160 are closer to the respective, exemplary threaded apertures of the exemplary locking arms 158, 160 than the exemplary second ends locking arms 158, 160.

The structures of the exemplary bracket 16 are sized and positioned such that the locking arms 158, 160 can be rotated approximately ninety degrees about the respective shafts 132, 134. The exemplary locking arms 158, 160 can be rotated between end limits of rotational travel including a retracted position and an extended position. The exemplary locking arms 158, 160 are shown the retracted position in FIGS. 6, 7 and 10. The exemplary locking arms 158, 160 are shown the extended position in FIGS. 8 and 9.

In an exemplary operation to install the bracket 14, a hole can be formed in the ceiling, such as with a hole saw. With the locking arms 158, 160 in the retracted position, the bracket 16 can be inserted in the hole until an upwardly-facing surface 170 of the flange 102 contacts the downwardly-facing surface of the ceiling. The installer can then engage the bit of a rotary tool with the driver indent 142 and rotate the worm 128 in a first rotational direction. For approximately the first ninety degrees of rotation, the exemplary locking arm 158 can rotate with the shaft 132.

Figure 8:
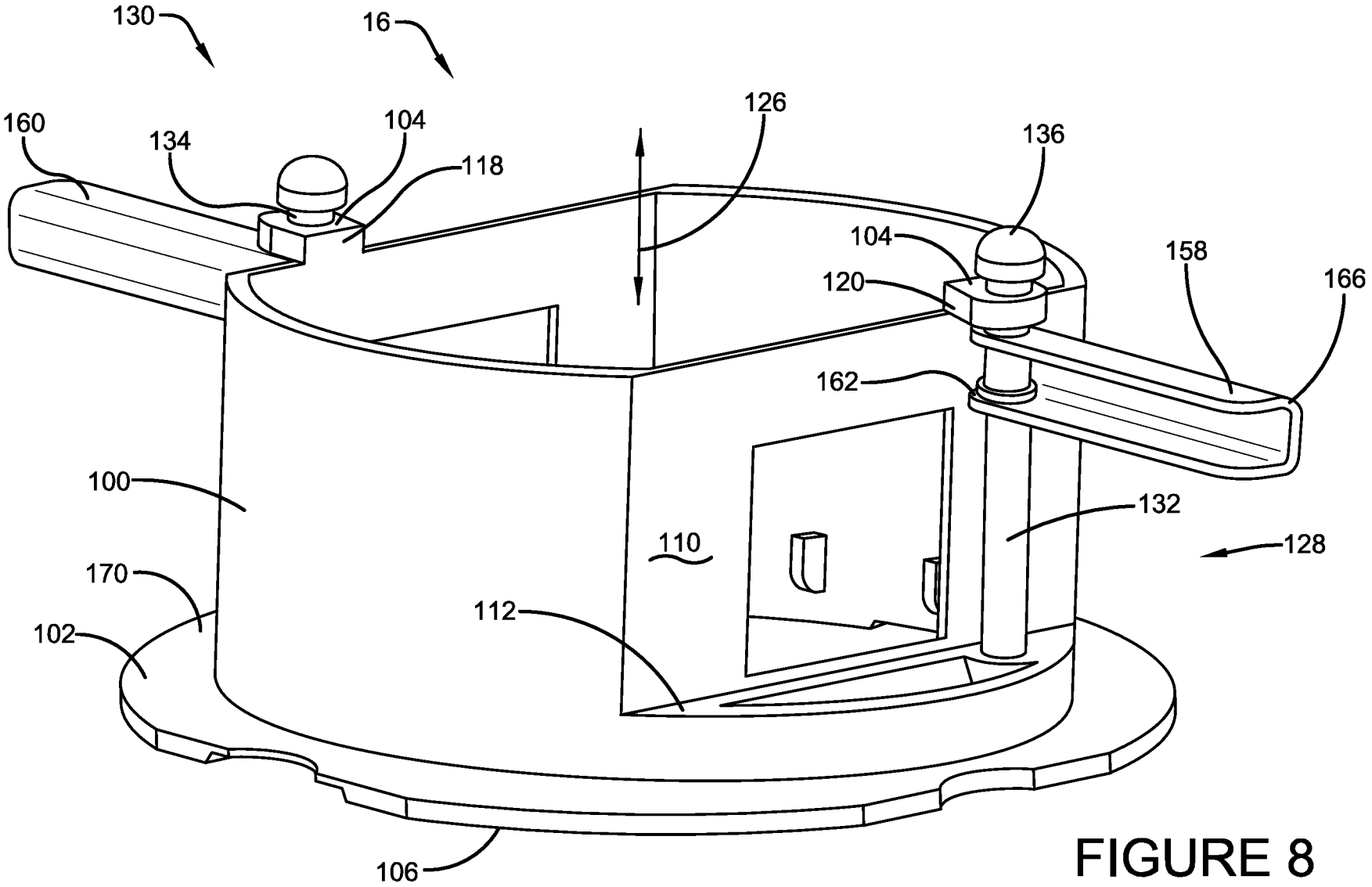
FIG. 8 is a third perspective view, generally from the side and above, of the bracket shown in FIG. 6 with locking arms in a raised and extended position.
Figure 9:
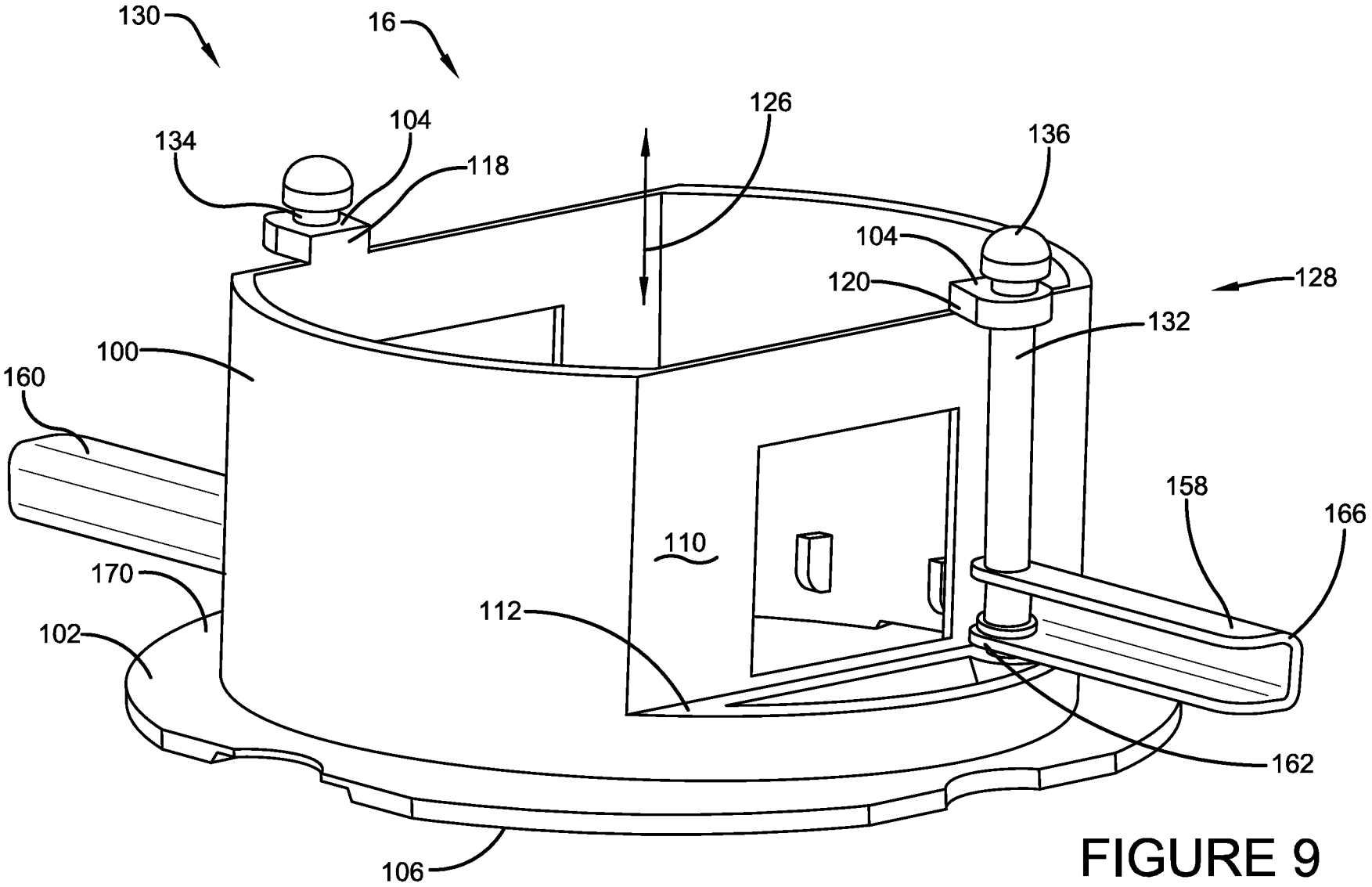
FIG. 9 is a fourth perspective view, generally from the side and above, of the bracket shown in FIG. 6 with locking arms in a lowered and extended position.
Figure 10:
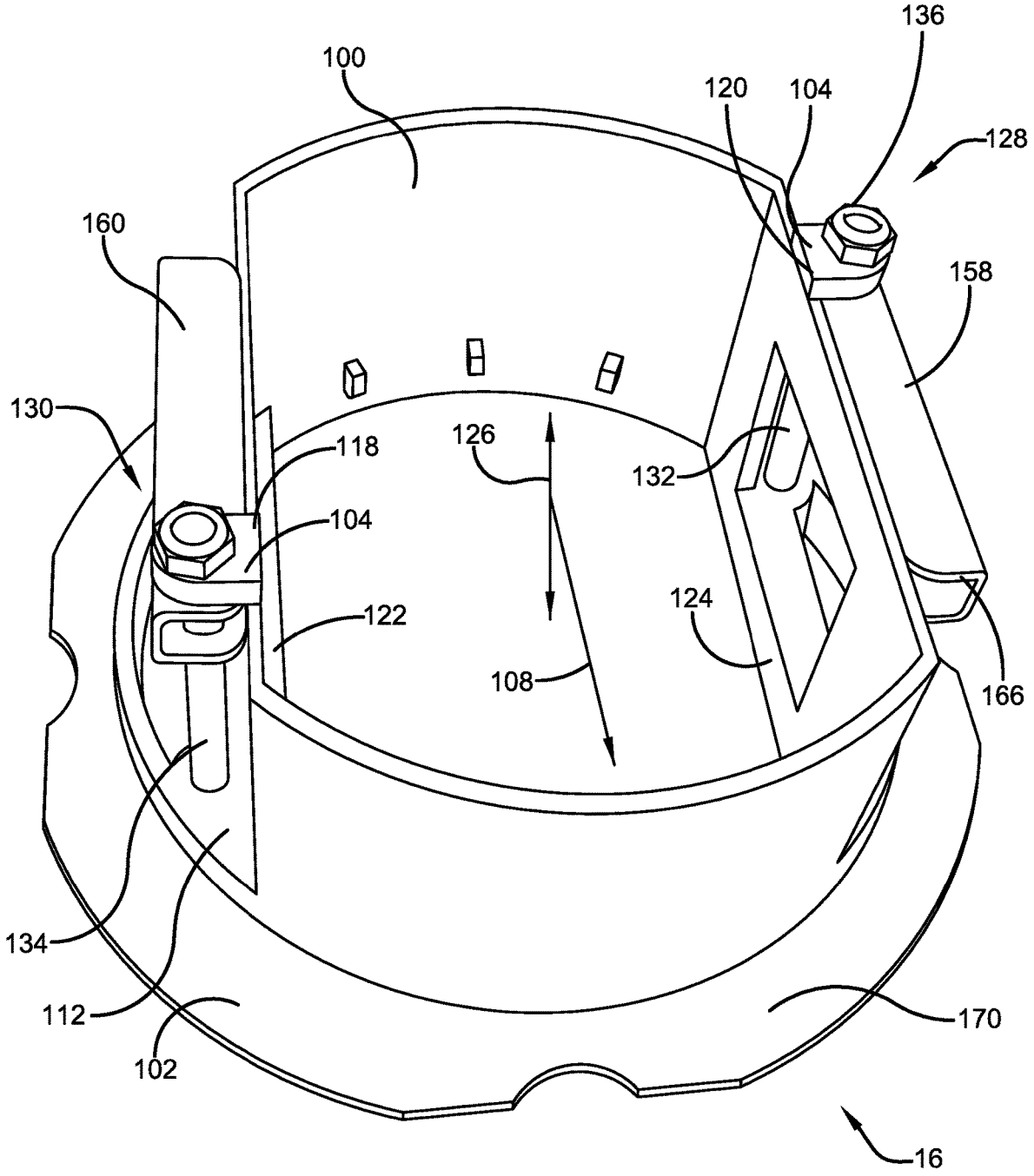
FIG. 10 is a fifth perspective view, generally from the side and above, of the bracket shown in FIG. 6 with locking arms in a retracted position.
Figure 11:
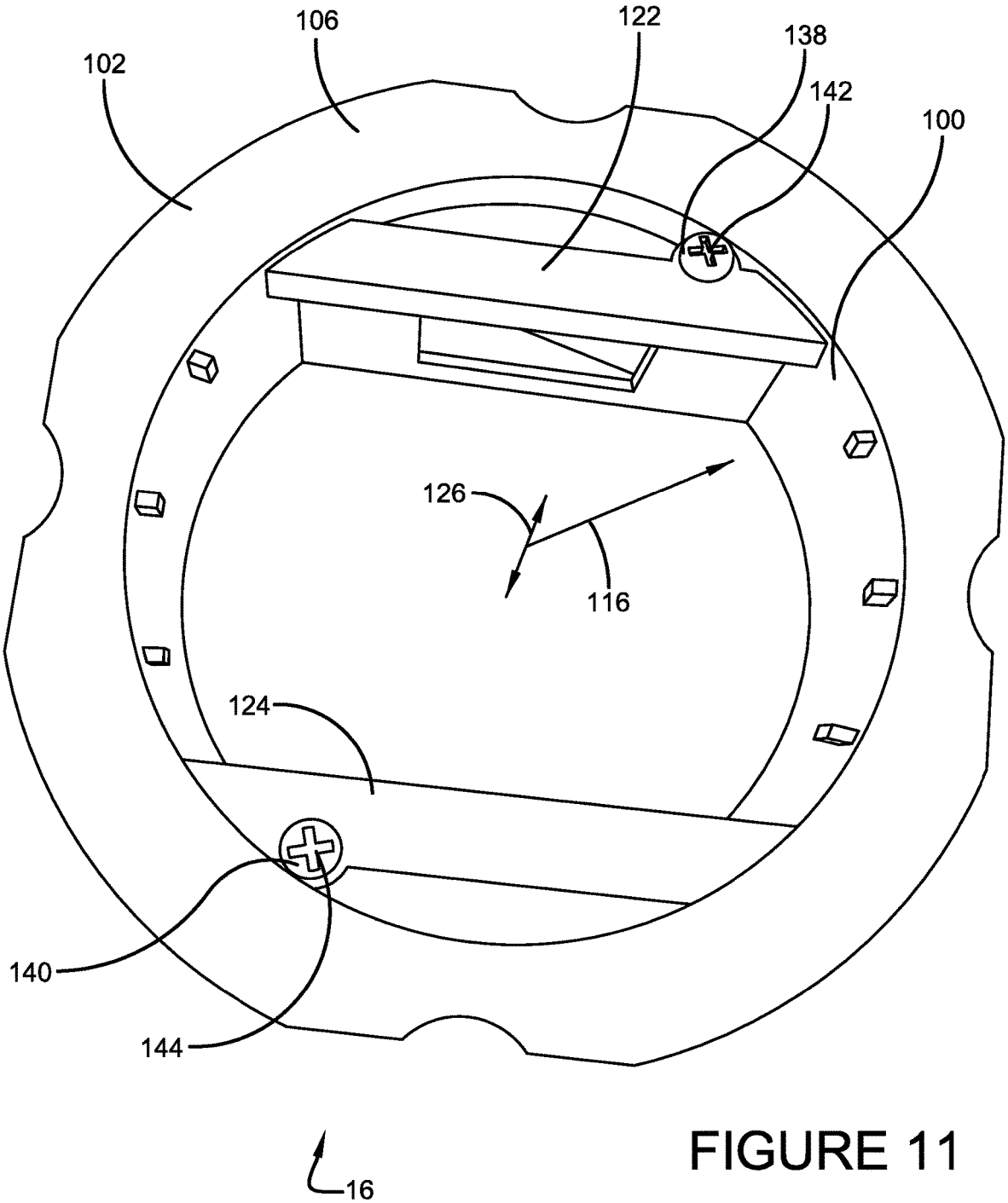
FIG. 11 is a sixth perspective view, generally from below, of the bracket shown in FIG. 6.
Figure 12:
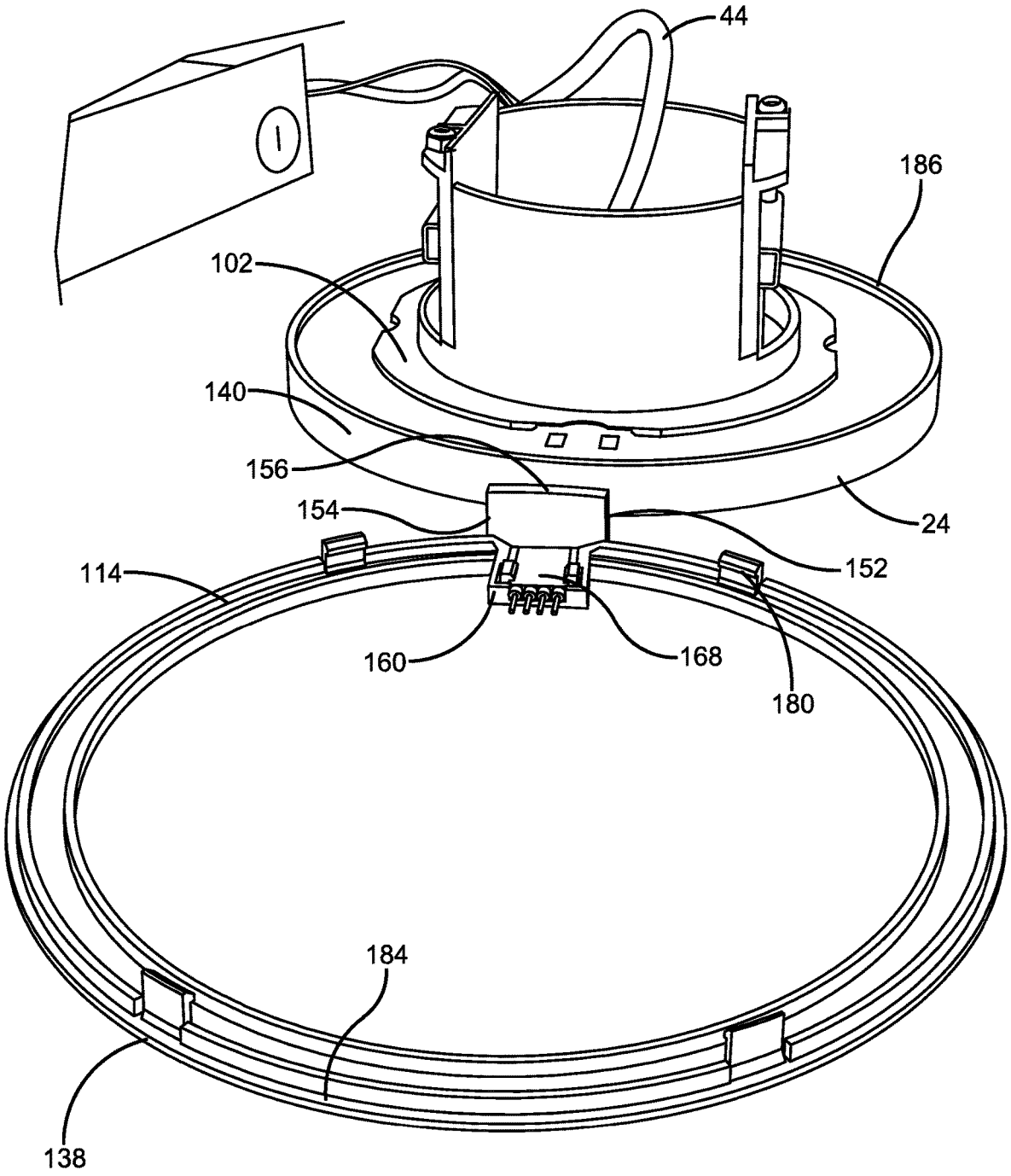
FIG. 12 is a perspective view of some of the components of the lighting arrangement shown in FIG. 1 wherein the components are partially disassembled.
Figure 13:
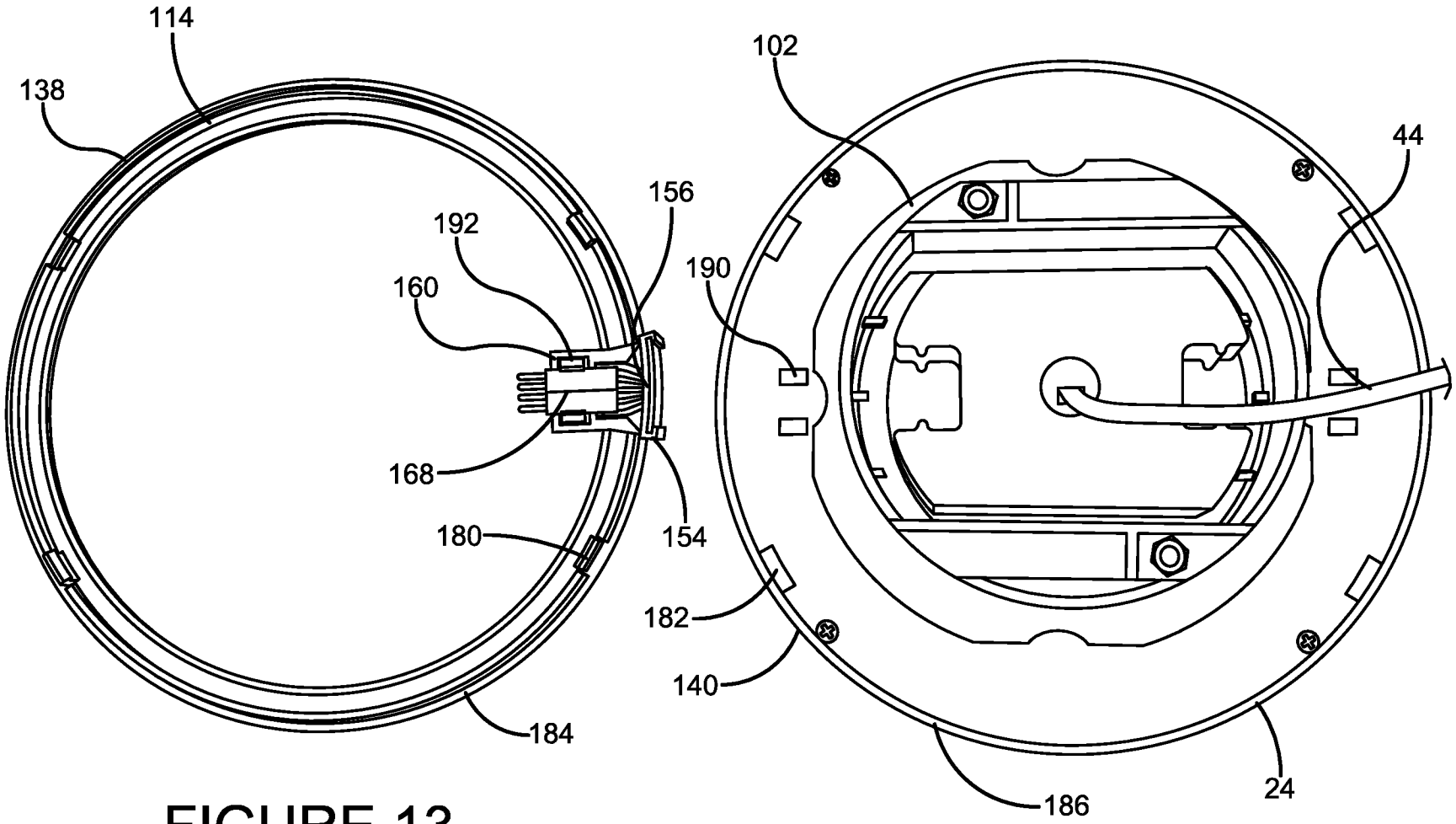
FIG. 13 is a perspective view of some of the components of the lighting arrangement shown in FIG. 1 wherein the components are partially disassembled.
Figure 14:
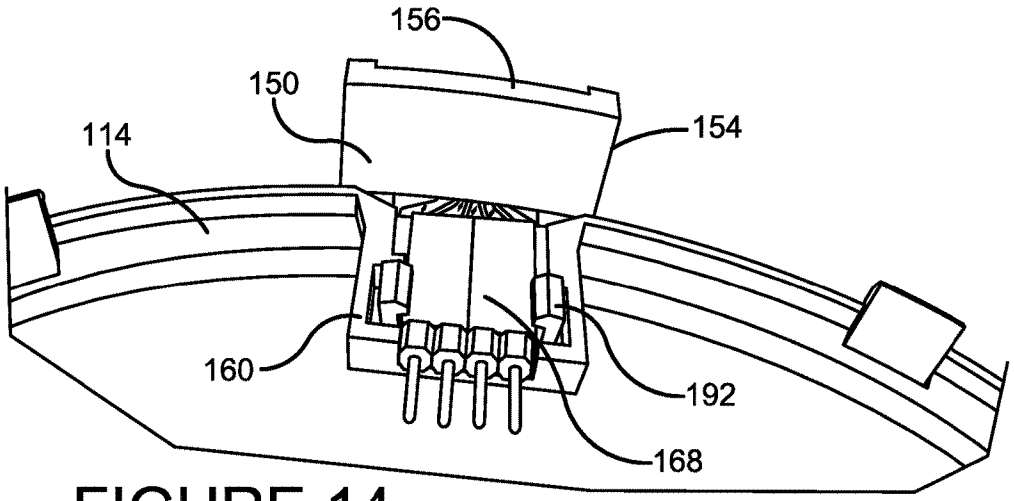
FIG. 14 is a perspective view of part of a ring portion of the lighting arrangement shown in FIG. 1.
Figure 15:
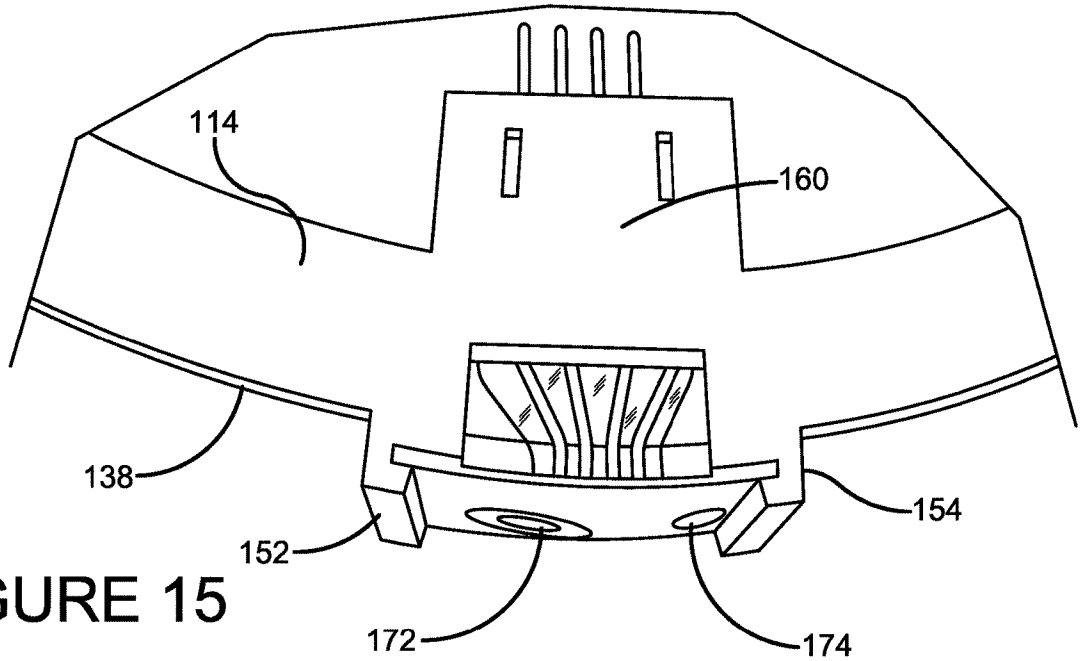
FIG. 15 is also a perspective view of part of the ring portion of the lighting arrangement shown in FIG. 1.
Figure 16:
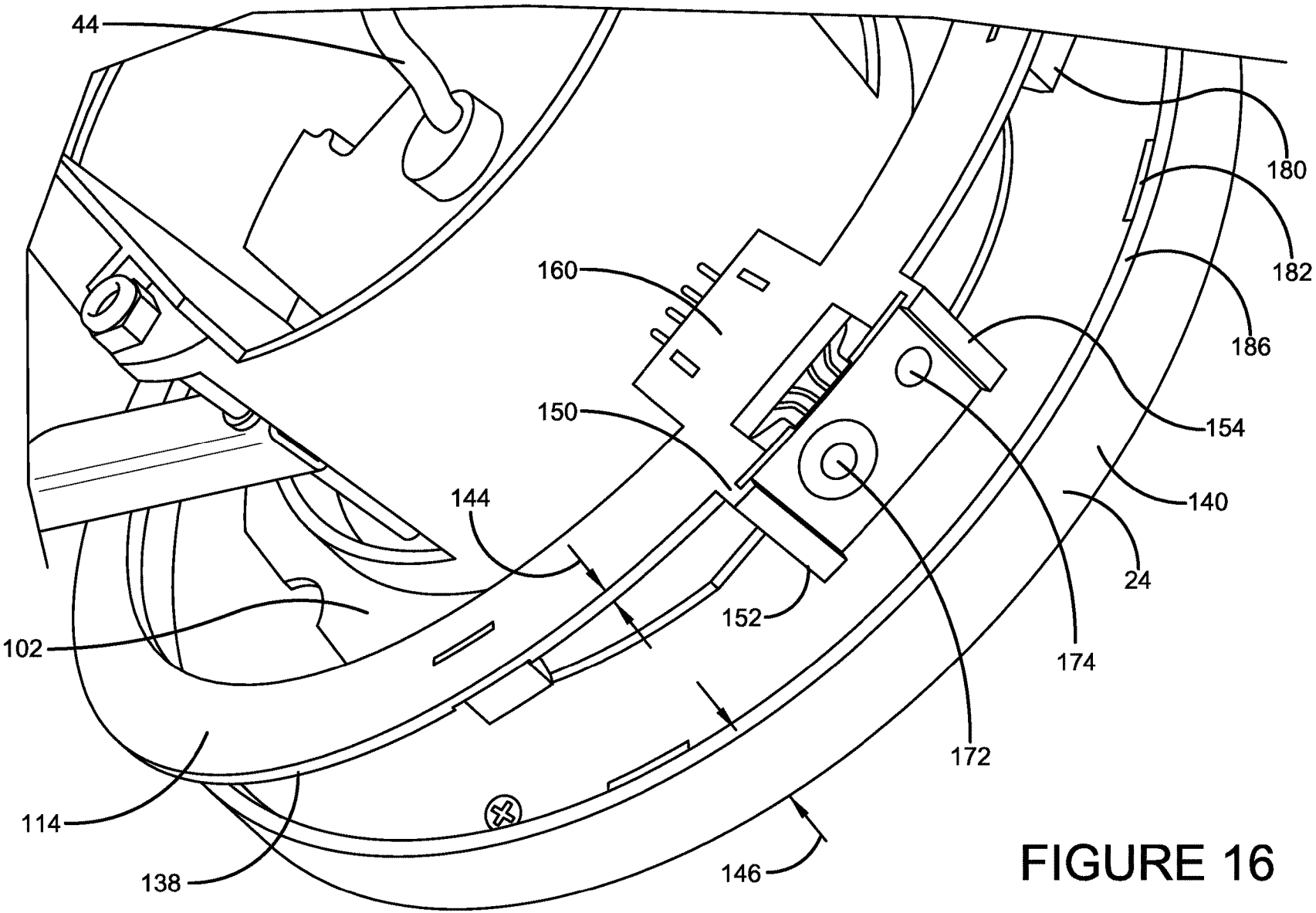
FIG. 16 is a perspective view of some of the components of the lighting arrangement shown in FIG. 1 being assembled.
Figure 17:
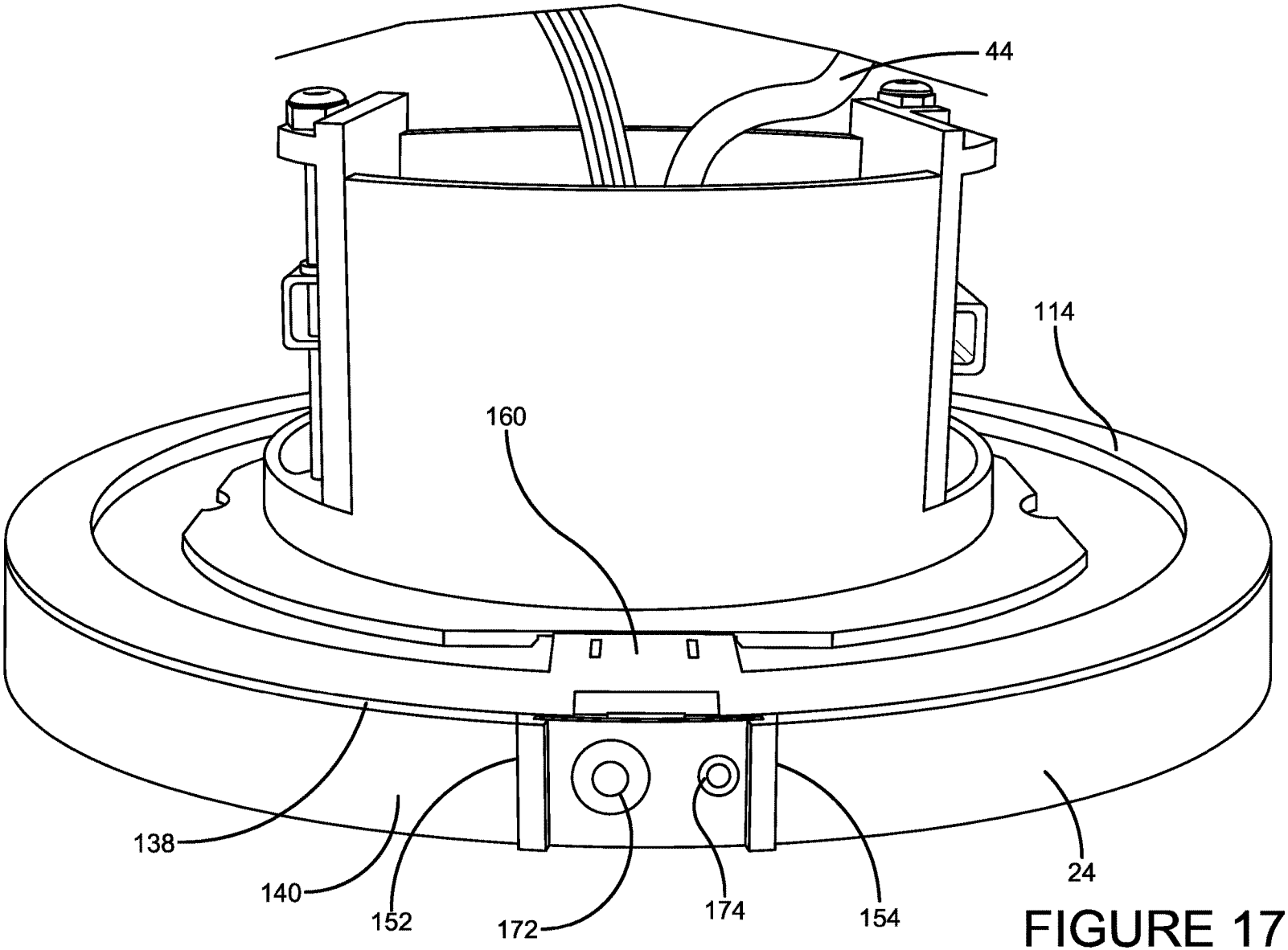
FIG. 17 is a perspective view of some of the components of the lighting arrangement shown in FIG. 1 wherein the components have been assembled.

In the exemplary embodiment, after approximately the first ninety degrees of rotation of the locking arm 158, the first end 162 contacts the horizontal wall 110. This condition is shown in FIG. 8. The engagement between the first end 162 and the wall 110 prevents further rotation of the locking arm 158 in the exemplary embodiment. Further rotation of the shaft 132 induces rectilinear movement of the locking arm 158 along the shaft 132, downward. The installer can further rotate the shaft 132 to move the locking arm 158 vertically downward along the shaft 132. This condition is shown in FIG. 9. The installer can further rotate the shaft 132 to move the locking arm 158 vertically downward until the ceiling and any other supporting structure is gently pinched between the locking arm 158 and the flange 102. The installer can then repeat the process with the locking arm 160 and worm 130. After the bracket 16 is installed, the luminaire 12 can be mounted to the bracket 16.

It is noted that the process can be practiced in reverse. While the bracket 16 is installed, the installer can engage the bit of a rotary tool with the driver indent 142 and rotate the worm 128 in a second rotational direction opposite to the first rotational direction to induce upward movement of the locking arm 158. When the locking arm 158 reaches the top of the shaft 132, further rotation induces rotation of the locking arm 158 from the extended position to the retracted position. When the locking arm 160 is similarly moved to the retracted position, the bracket 16 can be pulled out of the ceiling.

The trim ring assembly 20 is selectively engageable with the first housing 46. The exemplary trim ring assembly 20 includes a ring portion 114 configured to rest on the frame 24 when the trim ring assembly 20 is engaged with the first housing 46. The exemplary ring portion 114 includes a radially outer surface 138. Over most of its perimeter, the radially outer surface 138 has a radius that is equal to or less than a radius of a radially outer surface 140 of the frame 24. Further, the exemplary ring portion 114 defines a height along the axis 126 that is substantially smaller than a height of the luminaire 12 along the axis 126. These heights are respectively referenced at 144, 146 in the Figures. In various embodiments of the present disclose, the height 144 can be less than half the height 146, less than one-tenth the height 146, or other some other size. Thus, the ring portion 114, over most of its perimeter, can be inconspicuous when engaged with the housing 46. The appearance of the luminaire 12 is substantially the same whether or not the ring portion 114 is positioned on the frame 24 over most of the perimeter of the frame 24.

The exemplary ring portion 114 also includes a panel 150 extending along the axis 126 and projecting radially outward relative to the surface 138. The exemplary panel 150 has a width that is defined about the axis 126, between side edges 152, 154. The width of the exemplary panel 150 is about one-eighteenth of the entire annular perimeter of the exemplary ring portion 114. The exemplary panel 150 extends along the axis 126, beyond the surface 138, to a bottom edge 156, to overlay a portion of the surface 140.

The trim ring assembly 20 also including a test button 172 and an indicator light 174 mounted on the panel 150 of the ring portion 114. The exemplary ring portion 114 also includes a boss 160 extending radially inward from the panel 150, toward the axis 126. The boss 160 is configured to retain a terminal 168 of wiring extending to the test button 172 and the indicator light 174. Referring again to FIG. 2, the exemplary battery backup portion 18 includes sixth wiring 176 extending from the microcontroller unit 86 of the converter portion 80. The exemplary sixth wiring 176 extends to a terminal 178 that mates with the terminal 168. The sixth wiring 176, through terminals 168, 178, interconnects both the test button 172 and the indicator light 174 with the microcontroller unit 86.

When the test button 172 is pressed, the indicator light 174 will illuminate if the battery portion 76 retains charge sufficient to power the LED arrays if power from the external AC grid 72 is lost. FIG. 5 illustrates one approach to connecting the button 172 and indicator light 174 (which can be an LED) to the circuit. The microcontroller unit 86 can be measuring/monitoring the voltage of the battery portion 76. The microcontroller unit 86 can output a signal through wiring 176 that is connected to the indicator light 174. The microcontroller unit 86 can be configured to turn on the output when the battery portion 76 is charged when the user presses the button 172, causing the indicator light 174 to illuminate. If the battery portion 76 were not charged, the output would be off and pressing the button 172 would not cause the indicator light 174 to illuminate.

Figure 18:
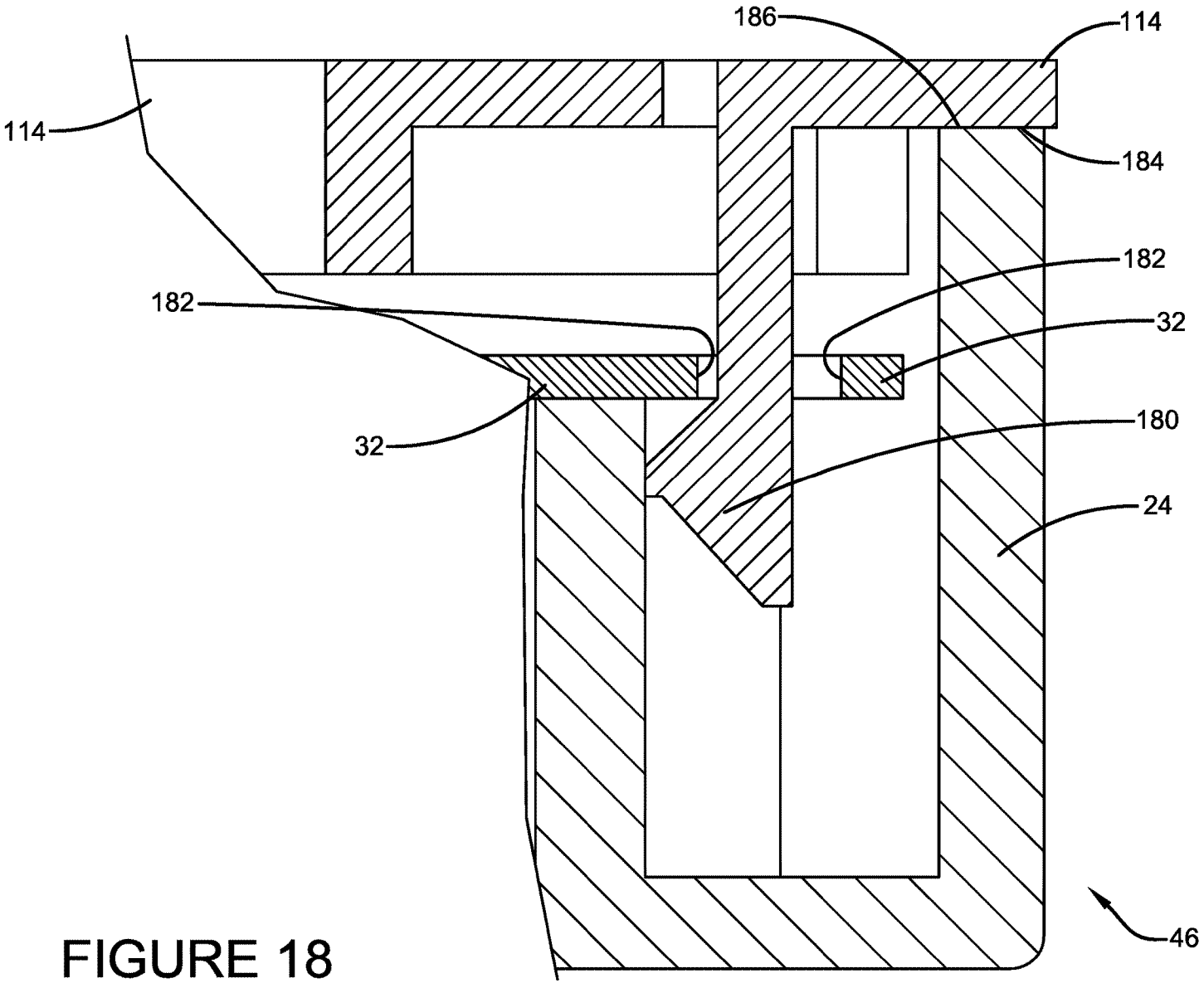
FIG. 18 is a partial cross-section taken through section lines 18-18 in FIG. 3.

The exemplary ring portion 114 is engageable with the first housing 46 through a releasable snap-fit. The exemplary ring portion 114 includes four snap-arms, such as one referenced at 180 in FIG. 18. Each snap-arm is received in an aperture defined in the back cover 32, such as one referenced at 182 in FIG. 18. When the exemplary ring portion 114 is connected to the first housing 46, the exemplary ring portion 114 can be lowered onto the frame 24 as the snap-arms are aligned with the apertures in the back cover 32. The snap arms can be elastically deformed while passing through the apertures and return to static form when passage through the apertures is complete. FIG. 18 shows the structures when passage of the snap-arms through the apertures is complete. The snap-arms define ramp surfaces in both vertical directions to all for easy assembly and disassembly. When passage of the snap-arms through the apertures is complete, a bottom or downwardly-facing surface 184 of the ring portion 114 rests on a top or upwardly-facing surface 186 of the frame 24.

The positions of the apertures in the back cover 32 are positioned so as to ensure alignment between the terminal 168 and one of two notches formed in the alignment cap 34. One of the two notches is referenced at 188 in FIG. 4. The back cover 32 also includes apertures such as aperture 190 that are configured to receive tangs 192 defined by the boss 164.

In any exemplary operation associated with the first exemplary embodiment, an aperture can be formed in the ceiling. Next, wiring connected to the external AC grid 72 can be drawn through the aperture and the fifth wiring of the battery backup portion 18 can be spliced to the wiring connected to the external AC grid 72. Next, the third wiring 70 of the driver circuitry assembly 14 can spliced to the fourth wiring 90 of the battery backup portion 18. The second housing 74 of the driver circuitry assembly 14 can then be interconnected with the third housing 94 of the battery backup portion 18. Also, the sixth wiring 176 can be strung through the third housing 94 of the battery backup portion 18. The interconnected housings 74 and 94 can then be moved through the aperture in the ceiling placed above the ceiling.

Next, the mounting bracket 16 can be inserted through the aperture in the ceiling with the locking arms 158, 160 in the retracted position. Next, the shafts 132, 134 can be turned until the ceiling is gently pinched between the locking arms 158, 160 and the flange 102. Next, the sixth wiring 176 and the second wiring 66 of the driver circuitry assembly 14 can be strung through the mounting bracket 16.

Then, the sixth wiring 176 and the second wiring 66 of the driver circuitry assembly 14 can be strung through the ring portion 114. The terminals 168, 178 can then be engaged with one another. Next, the snap-arms of the ring portion 114 can be received in the apertures in the back cover 32. The sixth wiring 176 can be guided through the notch 188. Next, the electrical plug connectors 36, 68 can be engaged with one another and the luminaire 12 and the trim ring assembly 20 can be raised into the mounting bracket 16. The luminaire 12 and the trim ring assembly 20 can be raised unit the bowed portions of the springs 48, 148 recover their shapes and rest on the shelves 122, 124 of the bracket 16. The process as described in can be performed in reverse to remove the luminaire 12.

Figure 19:
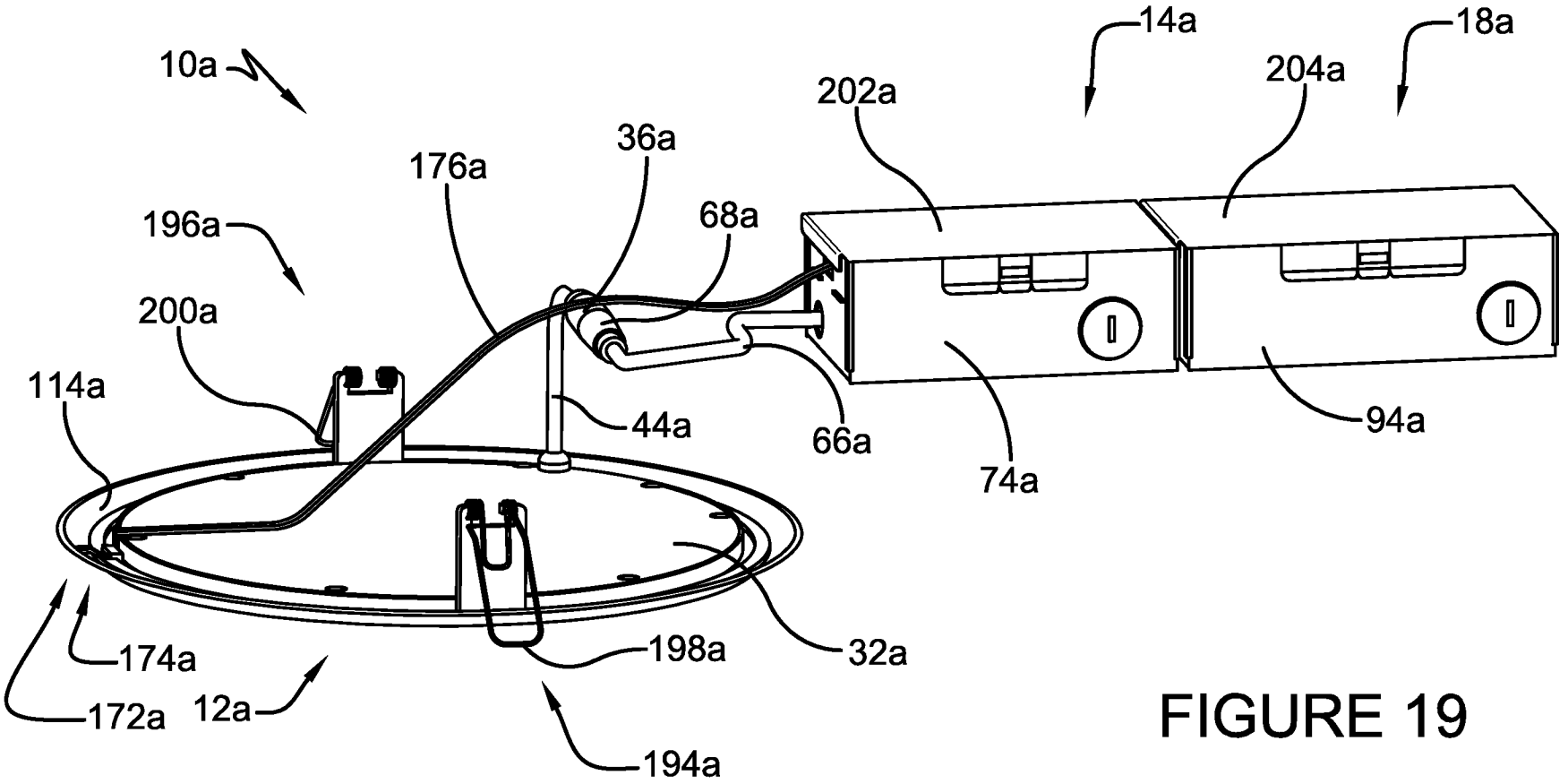
FIG. 19 is a perspective view of a lighting arrangement according to another exemplary embodiment of the present disclosure.
Figure 20:
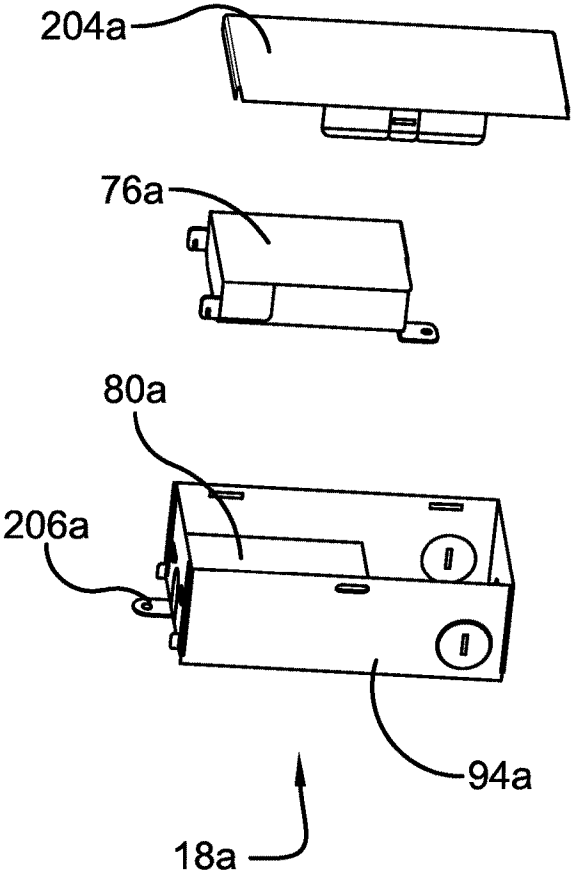
FIG. 20 is a partially exploded view of the lighting arrangement shown in FIG. 19.
Figure 20:
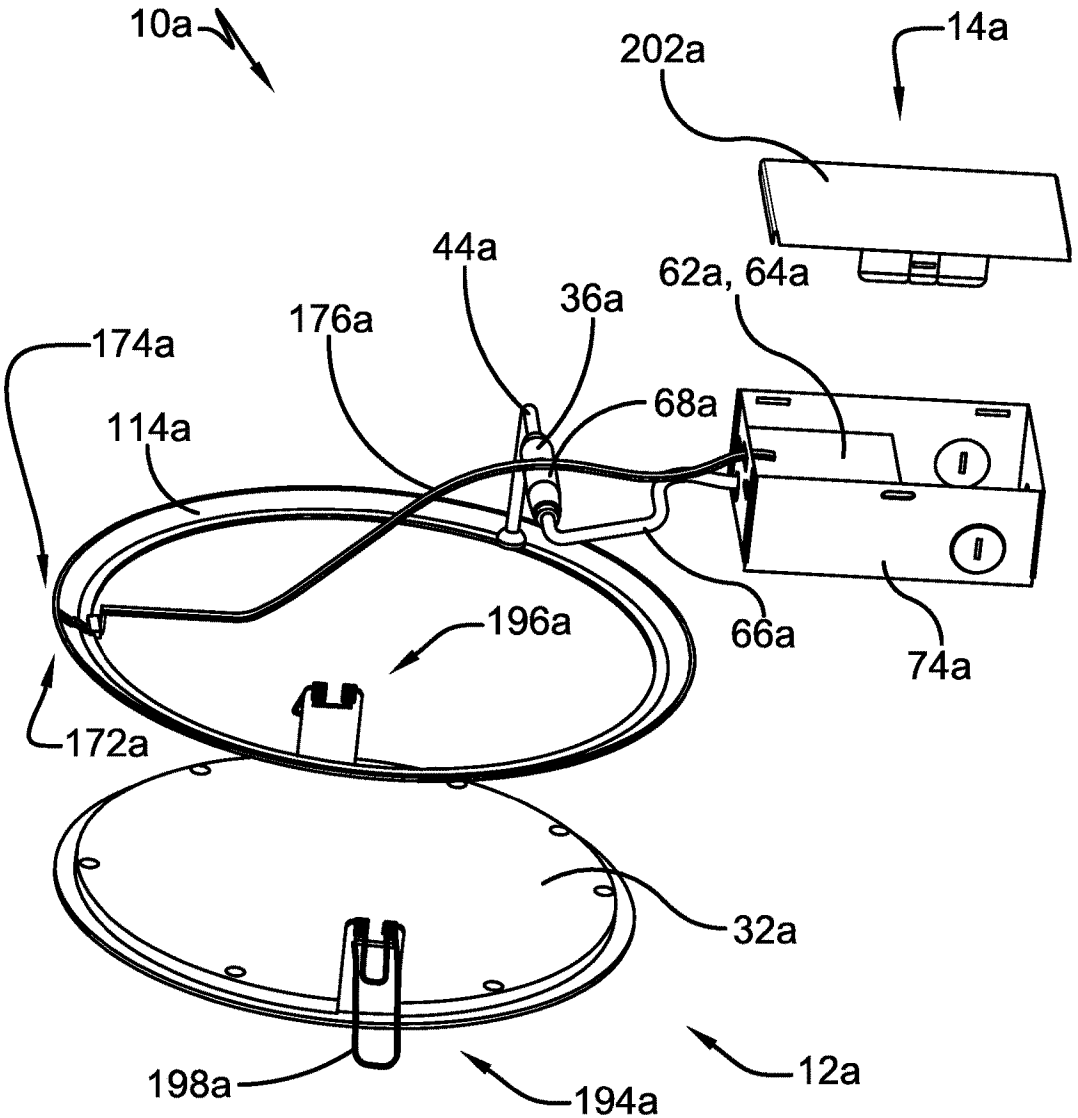

FIGS. 19-20 disclose another embodiment of the present disclosure. An exemplary lighting arrangement **10*a* includes a luminaire 12*a*, a ring portion 114*a*, a driver circuitry assembly 14*a*, and a battery backup portion 18*a*. The luminaire 12*a* and ring portion 114*a* can be mounted to a ceiling or a wall. The driver circuitry assembly 14*a* and battery backup portion 18*a* can be positioned above the ceiling or in a wall and supply power to the luminaire 12*a***.

The luminaire **12*a* can include a diffusor, a light guide, a light engine, and a back cover. The luminaire 12*a* can be constructed similarly to the luminaire 12. The diffusor, the light guide, and the light engine can be positioned in the luminaire 12*a*, closed by the back cover 32*a*. The light engine can include a printed circuited board (PCB) and a plurality of light emitting diodes (LEDs). The luminaire 12*a* can also include a first wiring 44*a* and electrical plug connector 36*a* that allows for the passage of electrical power to the light engine. The first wiring 44*a* passes out of the back cover 32*a* of the luminaire 12*a* and interconnects the electrical plug connector 36*a*** and the PCB of the light engine.

The luminaire **12*a* can also include a pair of spring clips 194*a*, 196*a*. Respective distal ends 198*a*, 200*a* of the spring clips 194*a*, 196*a* can be urged up and then toward a center of the luminaire, bending a portion of the spring clips 194*a*, 196*a*, when positioning the ring portion 114*a* on the luminaire 12*a*. While bent, the spring clips 194*a*, 196*a* can be received through the center aperture of the ring portion 114*a* and the ring portion 114*a* can be positioned on the luminaire 12*a***.

The exemplary driver circuitry assembly **14*a* includes second wiring 66*a*, a plug or socket-type electrical plug connector 68*a*, and a housing 74*a* with a removable cover 202*a*. Wiring from the electrical system of a building can be directed to the driver circuitry assembly 14*a* to supply the driver circuitry assembly 14*a* with power off of the grid. Power from the grid is supplied to driver circuitry (such as rectifier 62 and an IC chip 64) positioned in the housing 74***a* of the driver circuitry assembly 14*a*. The circuitry converts the electrical current/power as desired. The second wiring 66*a* is electrically connected to the internal circuitry to receive electrical current/power for the light engine. The second wiring 66*a* passes out of the housing 74*a* and extends to the electrical plug connector 68*a*. The terminals 36*a*, 68*a* are configured to selectively connect and disconnect as desired.

The exemplary battery backup portion 18*a* includes a housing 94*a* with a removable cover 204*a*, a battery portion 76*a*, and a converter portion 80*a*. The battery portion 76*a* and the converter portion 80*a* are contained in the housing 94*a*. Power from the grid can be directed into the battery backup portion 18*a* and then directed to the driver circuitry assembly 14*a*. A mechanical connector for connecting the housings 74*a*, 94*a* is referenced at 206*a*. The exemplary connector 206*a* is a tab with an aperture that can be inserted in a slot (not visible) in the rear wall of the housing 74*a*. After insertion of the connector 206*a* into the housing 74*a*, a fastener such as a bolt or set screw can be screwed into the aperture of the connector 206*a*. Each of the housings 74*a*, 94*a* can thus be self-contained units.

A test button 172*a* and indicator light 174*a* can be mounted in the ring portion 114*a*. Sixth wiring 176*a* can extend from the test button 172*a* and indicator light 174*a* to the battery backup portion 18*a*.

In an exemplary operation to install the lighting arrangement 10*a*, a hole can be formed in the ceiling. Wiring from the building can then be interconnected with the battery portion 76*a* and thus the internal circuitry of the driver circuitry assembly 14*a*. The battery backup portion 18*a* and the driver circuitry assembly 14*a* can then be moved through the hole and above the ceiling. Next, one of the connectors 36*a* and 68*a* can be strung through the ring portion 114*a* and the connectors 36*a* and 68*a* can be interconnected. The ring portion 114*a* can then be placed on back cover 32*a*. The exemplary ring portion 114*a* is freely rotatable on the back cover 32*a*.

Then the spring clips 194*a*, 196*a* can be bent back and the luminaire 12*a* can be raised. After the luminaire 12*a* is in the hole, the spring clips 194*a*, 196*a* can be released and can recover after passing the edge of the hole in the ceiling to hold the luminaire 12*a* in place. It is noted that the spring clips 194*a*, 196*a* can be utilized to mount the luminaire 12*a* in a can of a recessed light in one or more embodiments of the present disclosure.

Figure 21:
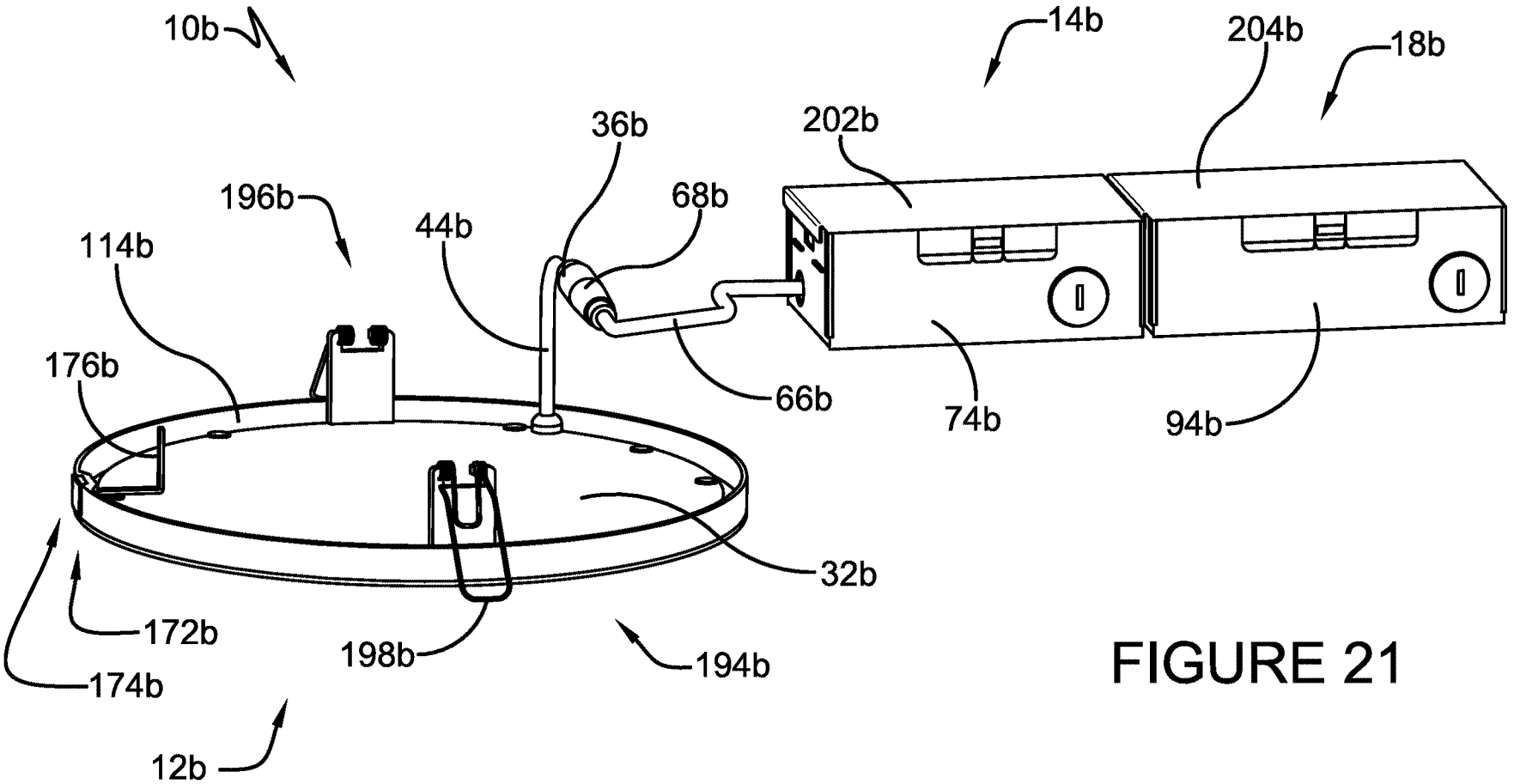
FIG. 21 is a perspective view of a lighting arrangement according to another exemplary embodiment of the present disclosure.
Figure 22:
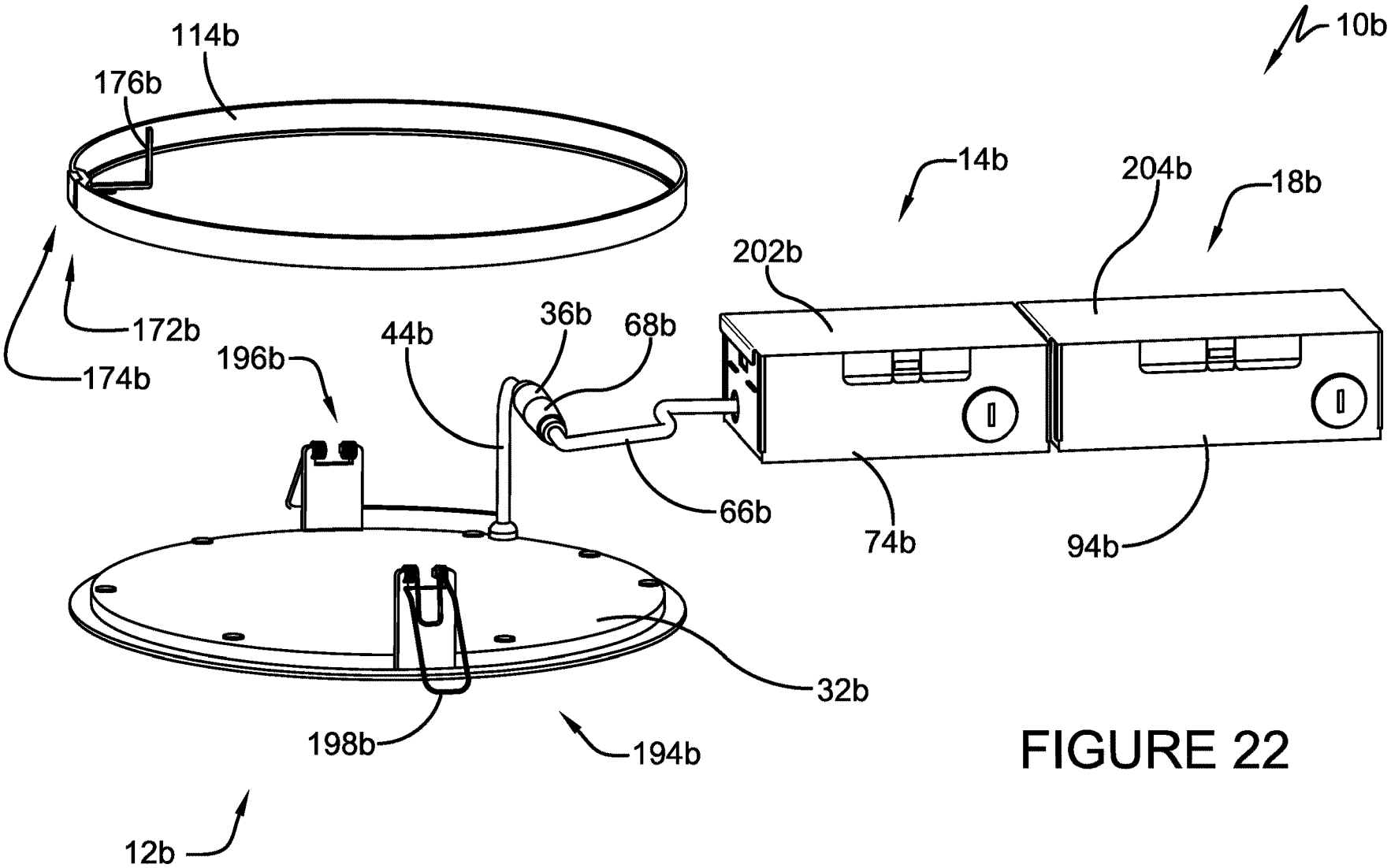
FIG. 22 is a partially exploded view of the lighting arrangement shown in FIG. 21.

FIGS. 21-22 disclose another embodiment of the present disclosure. An exemplary lighting arrangement 10*b* includes a luminaire 12*b*, a ring portion 114*b*, a driver circuitry assembly 14*b*, and a battery backup portion 18*b*. The luminaire 12*b* and ring portion 114*b* can be mounted to a ceiling or a wall. The driver circuitry assembly 14*b* and battery backup portion 18*b* can be positioned above the ceiling or in a wall and supply power to the luminaire 12*b*.

The luminaire 12*b* can include a diffusor, a light guide, a light engine, and a back cover. The luminaire 12*b* can be constructed similarly to the luminaire 12. The diffusor, the light guide, and the light engine can be positioned in the luminaire 12*b*, closed by the back cover 32*b*. The light engine can include a printed circuited board (PCB) and a plurality of light emitting diodes (LEDs). The luminaire 12*b* can also include a first wiring 44*b* and electrical plug connector 36*b* that allows for the passage of electrical power to the light engine. The first wiring 44*b* passes out of the back cover 32*b* of the luminaire 12*b* and interconnects the electrical plug connector 36*b* and the PCB of the light engine.

The luminaire 12*b* can also include a pair of spring clips 194*b*, 196*b*. Respective distal ends, such as distal end 198*b*, of the spring clips 194*b*, 196*b* can be urged up and then toward a center of the luminaire, bending a portion of the spring clips 194*b*, 196*b*, when positioning the ring portion 114*b* on the luminaire 12*b*. While bent, the spring clips 194*b*, 196*b* can be received through the center aperture of the ring portion 114*b* and the ring portion 114*b* can be positioned on the luminaire 12*b*.

The exemplary driver circuitry assembly 14*b* includes second wiring 66*b*, a plug or socket-type electrical plug connector 68*b*, and a housing 74*b* with a removable cover 202*b*. Wiring from the electrical system of a building can be directed to the driver circuitry assembly 14*b* to supply the driver circuitry assembly 14*b* with power off of the grid. Power from the grid is supplied to driver circuitry (such as rectifier 62 and an IC chip 64) positioned in the housing 74*b* of the driver circuitry assembly 14*b*. The circuitry converts the electrical current/power as desired. The second wiring 66*b* is electrically connected to the internal circuitry to receive electrical current/power for the light engine. The second wiring 66*b* passes out of the housing 74*b* and extends to the electrical plug connector 68*b*. The terminals 36*b*, 68*b* are configured to selectively connect and disconnect as desired.

The exemplary battery backup portion 18*b* includes a housing 94*b* with a removable cover 204*b*, a battery portion 76*b*, and a converter portion 80*b*. The battery portion 76*b* and the converter portion 80*b* are contained in the housing 94*b*. Power from the grid can be directed into the battery backup portion 18*b* and then directed to the driver circuitry assembly 14*b*.

A test button 172*b* and indicator light 174*b* can be mounted in the ring portion 114*b*. Sixth wiring 176*b* can extend from the test button 172*b* and indicator light 174*b* to the battery backup portion 18*b*. It is noted that the wiring 176*b* is truncated as illustrated, but does extend to the battery backup portion 18*b*.

In an exemplary operation to install the lighting arrangement 10*b*, a hole can be formed in the ceiling. Wiring from the building can then be interconnected with the battery portion 76*b* and thus the internal circuitry of the driver circuitry assembly 14*b*. The battery backup portion 18*b* and the driver circuitry assembly 14*b* can then be moved through the hole and above the ceiling. Next, one of the connectors 36*b* and 68*b* can be strung through the ring portion 114*b* and the connectors 36*b* and 68*b* can be interconnected. The ring portion 114*b* can then be placed on back cover 32*b*. The exemplary ring portion 114*b* is freely rotatable on the back cover 32*b*.

Then the spring clips 194*b*, 196*b* can be bent back and the luminaire 12*b* can be raised. After the luminaire 12*b* is in the hole, the spring clips 194*b*, 196*b* can be released and can recover after passing the edge of the hole in the ceiling to hold the luminaire 12*b* in place. It is noted that the spring clips 194*b*, 196*b* can be utilized to mount the luminaire 12*b* in a can of a recessed light in one or more embodiments of the present disclosure.

Figure 23:
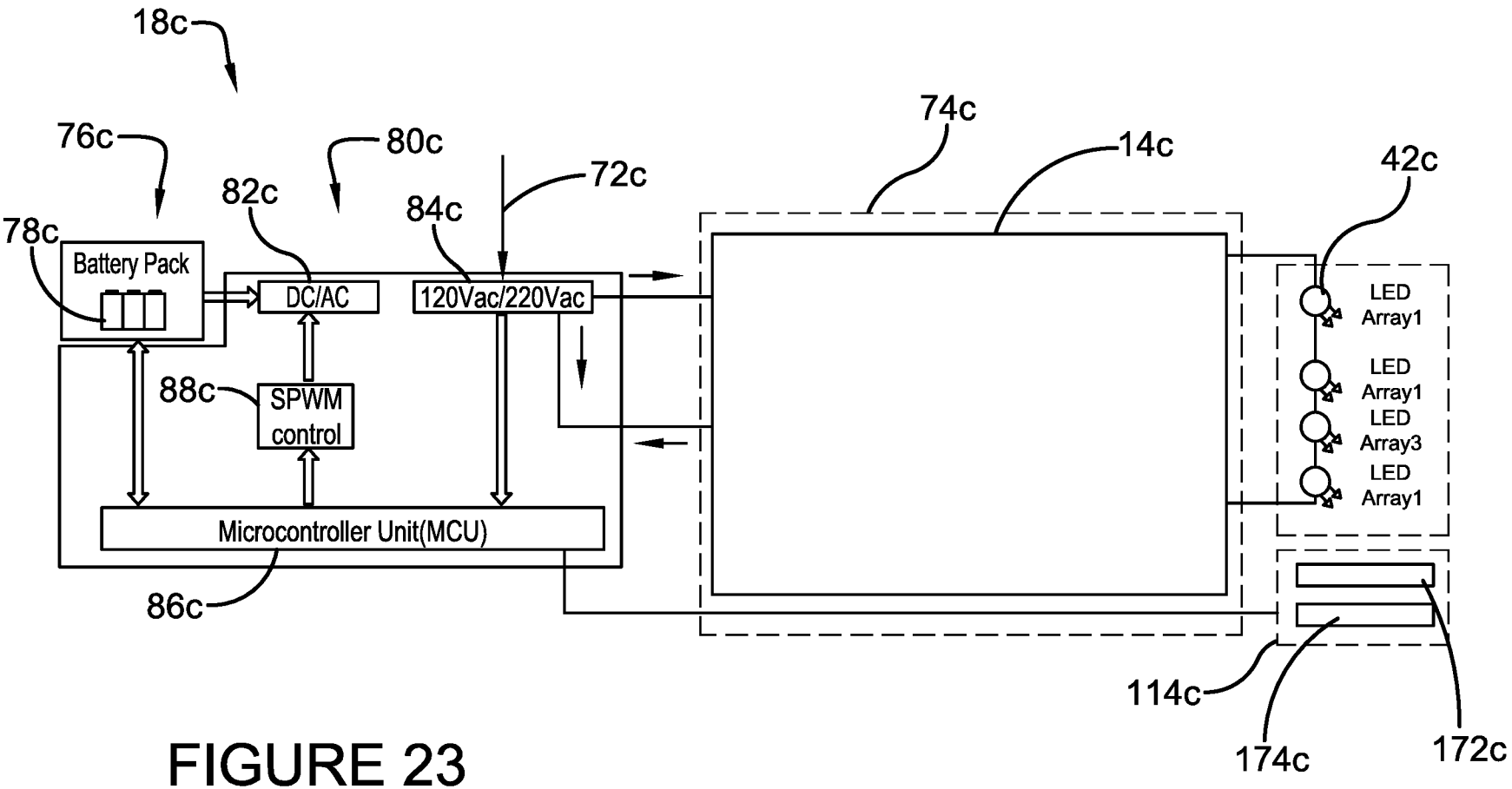
FIG. 23 is a circuit schematic of the lighting arrangement of another exemplary embodiment according to the present disclosure.
Figure 24:
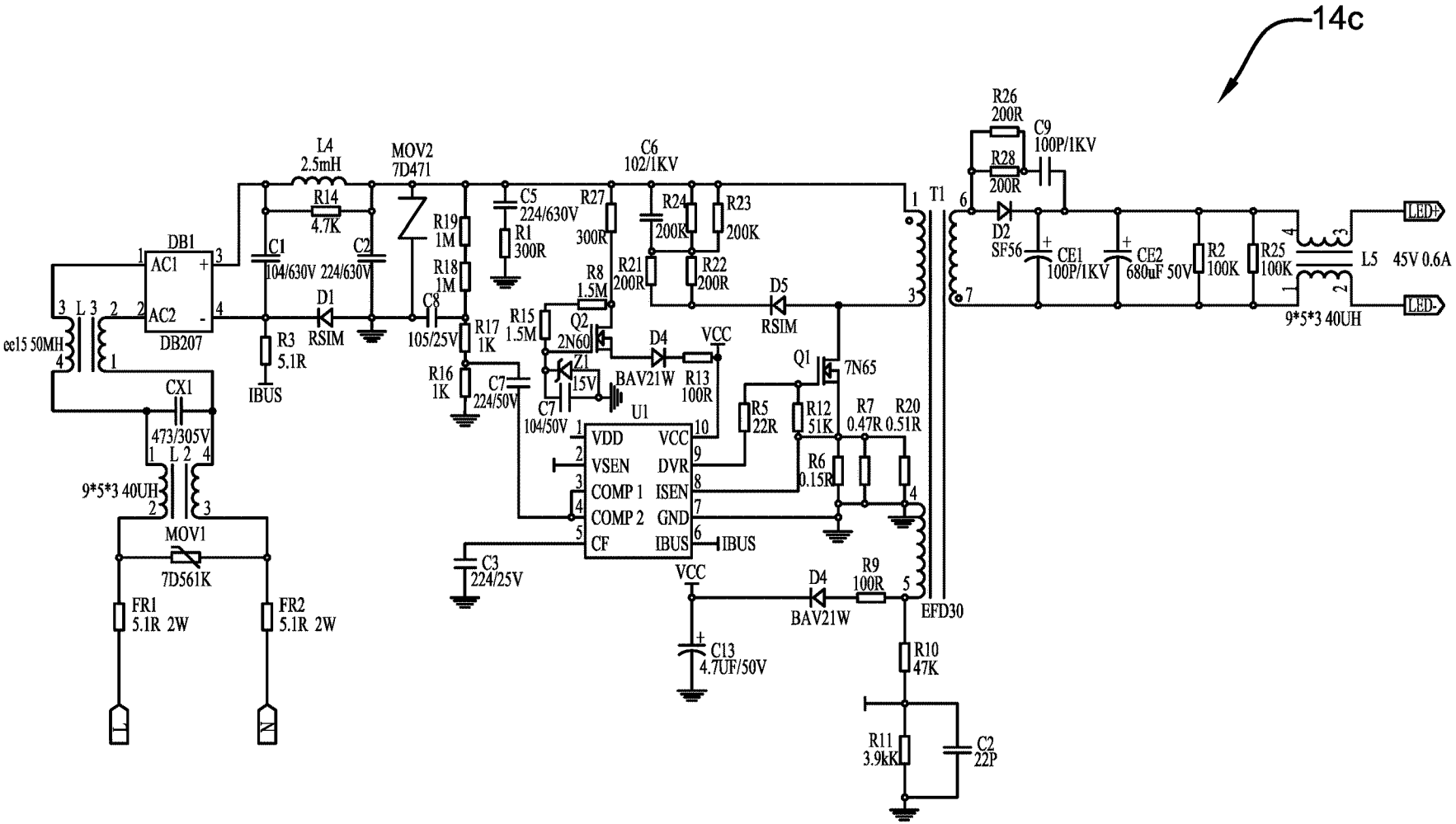
FIG. 24 is a detailed schematic of a switch mode power supply circuit that can be utilized the embodiment shown in FIG. 23.

FIGS. 23 and 24 are schematics associated with another exemplary embodiment of the present disclosure. A driver circuitry assembly 14*c* is shown as a black box in FIG. 23 and shown in detail in FIG. 24. The exemplary driver circuitry assembly 14*c* provides a switch mode power supply and is configured to drive a plurality of light emitting diodes 42*c*. The driver circuitry assembly 14*c* also has wiring configured to connect with the external AC grid, which is referenced at 72*c*. The exemplary driver circuitry assembly 14*c* also has a second housing 74*c*.

A battery backup portion 18*c* is selectively positionable between the driver circuitry assembly 14*c* and the external AC grid 72*c*. The exemplary battery backup portion 18*c* includes a battery portion 76*c* having one or more batteries 78*c* and a converter portion 80*c* with a DC-AC inverter/converter 82*c*. The converter portion 80*c* can be operably disposed between the battery portion 76*c* and the driver circuitry assembly 14*c*. The converter portion 80*c* can be configured to receive power from the one or more batteries 78*c* or the external AC grid 72*c*. Generally, low voltage DC from the one or more batteries can be converted to low voltage AC and then boosted to high voltage AC, which can be rectified to high voltage DC. The converter portion 80*c* can itself be powered by the battery portion 76*c*. The DC-AC inverter/converter 82*c* can be a functional group that includes a plurality of components such as a transistor, diode, capacitor, and transformer. The DC-AC inverter/converter 82*c* can convert relatively low DC voltage from the battery portion 76*c* into AC voltage. The box 84*c* simply refers to the output of the converter portion 80*c*.

The exemplary converter portion 80*c* also includes a microcontroller unit 86*c*. The microcontroller unit 86 is configured to route AC power to the rectifier 62 of the driver circuitry assembly 14*c* from either the external AC grid 72*c* or from the one or more batteries 78*c* when the driver circuitry assembly 14*c* and the battery backup portion 18*c* are engaged with one another. The microcontroller unit 86*c* can include voltage dividers, amplifiers, RAM, a timer, A/D, PWM, and other integrated functions. In one or more embodiments of the present disclosure, the microcontroller unit 86*c* can include an enhanced 8051 series MCU, such as a SH79F081A provided by Sino Wealth, alongside voltage dividers and amplifiers that enable the high voltages and currents to be measured by the A/D.

The exemplary converter portion 80*c* also includes a sinusoidal pulse-width modulation (SPWM) module 88*c*. The SPWM module 88*c* can be integral with the microcontroller unit 86*c*. The SPWM module 88*c* can generate a sinusoidal modulated pulse in response to a control signal emitted by the microcontroller unit 86*c* to SPWM module 88*c*. The pulse can be utilized to control the ON/OFF status of a transistor of the converter 82*c*, such as a MOSFET. When the transistor is open, the exemplary converter portion 80*c* can be engaged to communicate AC power. The microcontroller unit 86*c* can be arranged to monitor the delivery of AC power to the driver circuitry assembly 14*c* from the external AC grid 72*c*. When the primary or main electrical power is off due to an emergency, or power outage, or some other condition, the microcontroller unit 86*c* can emit the pulse to engage the other portions of the exemplary converter portion 80*c* and supply power to the driver circuitry assembly 14*c* from the battery portion 76*c*.

The battery portion 76*c* can have any desired physical size. The battery portion 76*c* can be defined by a single battery or an array of batteries 78*c* connected in series or in parallel. By way of example and not limitation, the battery portion 76*c* can include one or more Samsung® Model ICR18c650-26F batteries 78*c*, each having a length of sixty-five millimeters and a diameter of eighteen and four-tenths millimeters. This yields a volume of seventeen-thousand two-hundred and eighty-four square millimeters. The battery portion 76*c* can be rated at 3.8 volts, 2600 mAh and have a capacity is 9.88 cWh after being charged. In one embodiment of the present disclosure, three batteries 78*c* can be connected in series having a volume of fifty-one-thousand eight-hundred and fifty-one square millimeters.

The exemplary battery portion 76*c* and exemplary converter portion 80*c* can define an emergency back-up to the driver circuitry assembly 14*c*. The battery portion 76*c* and exemplary converter portion 80*c* can be formed as an integral exemplary battery backup portion 18*c* that can be attached to a junction box delivering electrical power to the driver circuitry assembly 14*c*. A user may operate the driver circuitry assembly 14*c* without the battery backup portion 18*c* if desired.

In one or more exemplary embodiments, the battery portion 76*c* can provide thirty watt-hours of power. When supporting a twenty-watt driver circuitry assembly 14*c* (or fixture), the battery portion 76*c* can thus provide power for one and a half hours. The power can be provided almost instantaneously; when power is lost from the standard or regular or non-emergency source, the microcontroller unit 86*c* can engage the inverter 82*c* to supply 120V, AC power to the driver circuitry assembly 14*c*.

FIG. 23 also discloses an exemplary ring portion 114*c* with a test button 172*c* and an indicator light 174*c* mounted on the panel 150 of the ring portion 114*c*. The exemplary ring portion 114*c* also includes a boss 160 extending radially inward from the panel 150, toward the axis 126. The boss 160 is configured to retain a terminal 168 of wiring extending to the test button 172*c* and the indicator light 174*c*. When the test button 172*c* is pressed, the indicator light 174*c* will illuminate if the battery portion 76*c* retains charge sufficient to power the LEDs if power from the external AC grid 72*c* is lost. The microcontroller unit 86*c* can be measuring/monitoring the voltage of the battery portion 76*c*. The microcontroller unit 86*c* can output a signal through wiring connected to the indicator light 174*c*. The microcontroller unit 86*c* can be configured to turn on the output when the battery portion 76*c* is charged when the user presses the button 172*c*, causing the indicator light 174*c* to illuminate. If the battery portion 76*c* were not charged, the output would be off and pressing the button 172*c* would not cause the indicator light 174*c* to illuminate.

It is noted that the detailed schematic shown in FIG. 24 is exemplary. Other forms of switch mode power supplies can be practiced in embodiments of the present disclosure.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. The right to claim elements and/or sub-combinations that are disclosed herein is hereby unconditionally reserved. The use of the word "can" in this document is not an assertion that the subject preceding the word is unimportant or unnecessary or "not critical" relative to anything else in this document. The word "can" is used herein in a positive and affirming sense and no other motive should be presumed. More than one "invention" may be disclosed in the present disclosure; an "invention" is defined by the content of a patent claim and not by the content of a detailed description of an embodiment of an invention.

What is claimed is:

1. A lighting arrangement comprising:

a luminaire having a plurality of light emitting diodes in an array string, a first wiring extending from said array string and terminating in a first electrical plug connector, and a first housing, wherein said plurality of light emitting diodes in said array string is positioned in said first housing and said first electrical plug connector is positioned outside of said first housing;

a driver circuitry assembly for driving said plurality of light emitting diodes and including circuitry with a rectifier and an IC chip configured to drive said plurality of light emitting diodes with the rectified voltage provided by said rectifier, said driver circuitry assembly also having a second wiring extending from said circuitry and terminating in a second electrical plug connector, said first electrical plug connector and said second electrical plug connector selectively engageable with one another, said driver circuitry assembly also having a third wiring configured to connect with the external AC grid, said driver circuitry assembly also having a second housing wherein said rectifier and said IC chip are positioned in said second housing and said second electrical plug connector is positioned outside of said second housing; and a battery backup portion selectively positionable between said driver circuitry assembly and the external AC grid and having one or more batteries and a converter portion with a DC-AC inverter, said converter portion configured to receive power from said one or more batteries or the external AC grid, said converter portion including a microcontroller unit, said microcontroller unit configured to route AC power to said rectifier of said driver circuitry assembly from either the external AC grid or from said one or more batteries when said driver circuitry assembly and said battery backup portion are engaged with one another, said battery backup portion also including a fourth wiring selectively engageable with said third wiring of said driver circuitry assembly, said battery backup portion also including a fifth wiring selectively engageable with the external AC grid, said battery backup portion also having a third housing containing said one or more batteries and said converter portion, wherein said fourth wiring and said fifth wiring extend out of said third housing, and wherein said third housing and said second housing are selectively interconnectable with one another.

2. The lighting arrangement of claim 1 further comprising:

a trim ring assembly selectively engageable with said first housing, said trim ring assembly including a ring portion configured to rest on said first housing when said trim ring assembly is engaged with said first housing, said trim ring assembly also including a test button and an indicator light mounted on said ring portion, wherein said battery backup portion also including sixth wiring extending from said converter portion and configured to interconnect with both of said test button and said indicator light.

3. The lighting arrangement of claim 2 wherein said battery backup portion further comprises:

a sixth wiring extending out of said third housing, through said second housing and extending further to said test button and said indicator light when said third housing and said second housing are interconnected with one another.

4. The lighting arrangement of claim 2 wherein said ring portion is further defined as engageable with said first housing through a releasable snap-fit.

5. The lighting arrangement of claim 2 wherein said ring portion is further defined freely rotatable when resting on said first housing.

6. The lighting arrangement of claim 1 wherein:

said first housing further comprise a slot; and said second housing further comprises a connector in the form of a tab with an aperture, said tab insertable in said slot to interconnect said first housing and said second housing.

* * * * *